US005851714A

United States Patent [19]

Taya et al.

[11] Patent Number: 5,851,714

[45] Date of Patent: Dec. 22, 1998

[54] TONER FOR DEVELOPING ELECTROSTATIC IMAGE AND FIXING METHOD

[75] Inventors: Masaaki Taya, Kawasaki; Kenji Okado, Yokohama; Ryoichi Fujita, Tokyo; Makoto Kanbayashi, Kawasaki; Tsuyoshi Takiguchi, Shizuoka-ken; Wakashi Iida, Higashikurume; Tetsuya Ida, Kawasaki, all of Japan

[73] Assignee: Canon Kabushiki Kaisha, Tokyo, Japan

[21] Appl. No.: 825,395

[22] Filed: Mar. 28, 1997

[30] Foreign Application Priority Data

Apr. 2, 1996 [JP] Japan ..... 8-102080

[51] Int. Cl.[6] ..... G03G 9/097

[52] U.S. Cl. ..... 430/110; 430/111; 430/124

[58] Field of Search ..... 430/110, 111, 430/124

[56] References Cited

U.S. PATENT DOCUMENTS

| | | | |
|---|---|---|---|
| 2,297,691 | 10/1942 | Carlson | 430/31 |
| 4,386,147 | 5/1983 | Seimiya et al. | 430/99 |
| 4,486,524 | 12/1984 | Fujisaki et al. | 430/190 |
| 5,180,649 | 1/1993 | Kukimoto et al. | 430/106.6 |
| 5,578,408 | 11/1996 | Kohtaki et al. | 430/106.6 |

FOREIGN PATENT DOCUMENTS

| | | |
|---|---|---|
| 0488360 | 6/1992 | European Pat. Off. . |
| 0516153 | 12/1992 | European Pat. Off. . |
| 50-44836 | 4/1975 | Japan . |
| 55-6895 | 2/1980 | Japan . |
| 56-98202 | 8/1981 | Japan . |
| 57-493 | 1/1982 | Japan . |
| 57-37353 | 3/1982 | Japan . |
| 61-213858 | 9/1986 | Japan . |
| 64-30061 | 1/1989 | Japan . |
| 1-295269 | 11/1989 | Japan . |
| 1-302267 | 12/1989 | Japan . |
| 3-96964 | 4/1991 | Japan . |
| 3-203746 | 9/1991 | Japan . |
| 4-24648 | 1/1992 | Japan . |
| 6-175395 | 6/1994 | Japan . |

*Primary Examiner*—Roland Martin
*Attorney, Agent, or Firm*—Fitzpatrick, Cella Harper & Scinto

[57] ABSTRACT

A toner for developing an electrostatic image is formed from toner particles containing at least a binder resin, a colorant and an organometallic compound. The binder resin in the toner particles has a tetrahydrofuran-insoluble (THF-insoluble) content of at most 5.0 wt.% based on the binder resin. The toner has a glass transition temperature of 50°–80° C. The toner further has storage modulus characteristics including a storage modulus at 80° C. ($G'_{80}$) of $1\times10^4$–$5\times10^6$ [dyn/cm$^2$], a storage modulus at 130° C. ($G'_{130}$) providing a ratio $G'_{80}/G'_{130}$ of 10–$5\times10^3$, and a storage modulus curve showing a minimum (G'min) in a temperature region of 110°–190° C. The toner especially exhibits excellent low-temperature fixability, anti-high temperature offset characteristic, storage stability and color-miscibility.

32 Claims, 5 Drawing Sheets

TONER FOR DEVELOPING ELECTROSTATIC IMAGE AND FIXING METHOD

FIELD OF THE INVENTION AND RELATED ART

The present invention relates to a toner for developing electrostatic images formed in image forming methods, such as electrophotography, electrostatic recording and electrostatic printing, and a fixing method for fixing the resultant toner image onto a transfer(-receiving) material under heat and pressure application.

In electrophotographic processes, as disclosed in U.S. Pat. Nos. 2,297,691 and 2,357,809, a photoconductive insulating layer is uniformly charged and then exposed to form an electrostatic image; the electrostatic image is developed with a toner [developing step]; the resultant toner image is transferred onto a transfer(-receiving) material, such as transfer paper, via or without via an intermediate transfer member [transfer step]; and the toner image is fixed onto the transfer material under application of heat, pressure, or heat and pressure [fixing step].

Accordingly, the toner has to exhibit performances required in not only the developing step but also in the transfer and fixing steps.

A toner is generally subjected to mechanical abrasion due to mechanical shearing force and impact within a developing device and is therefore liable to be deteriorated during copying or printing on a large number of sheets, such as several thousands to several tens of thousands sheets. Such toner deterioration may be prevented by using a tough binder resin having a large molecular weight sufficient to withstand the mechanical abrasion, but such a binder resin generally has a high softening point and requires a high heating roller temperature for sufficient fixing in the heat roller fixing scheme, which is a contact fixing scheme exhibiting a good heat efficiency and is widely used. A high heating roller temperature is liable to cause a deterioration of the fixing device, the curling of paper after the fixation, and an increased energy consumption. Further, such a binder resin has a poor pulverizability and causes a lower toner production efficiency.

On the other hand, the heat roller fixing scheme exhibits remarkably good heat efficiency because the heating roller surface contacts the toner image surface on the transfer sheet (or fixing sheet) under pressure, and is therefore widely used from a low-speed system to a high-speed system. However, at the time of the contact between the heating roller surface and the toner image surface, the toner is liable to cause an offset phenomenon that the toner is attached onto the heating roller surface and the attached toner is transferred onto a subsequent transfer material.

As is described in Japanese Patent Publication (JP-B) 55-6895 and Japanese Laid-Open Patent Application (JP-A) 56-98202, there has been known a method of suppressing the offset phenomenon by using a binder resin having a broadened molecular weight distribution, and the resin is caused to have a high polymerization degree and a high fixing temperature.

There have been also proposed a method of suppressing the offset phenomenon by using a nonlinear or crosslinked resin as disclosed in JP-B 57493, JP-A 50-44836, and JP-A 57-37353; and attaining an improved anti-offset performance by using polyester resins crosslinked with metal ions as disclosed in JP-A 61-213858, JP-A 1-295269, JP-A 1-30061, JP-A 1-302267 and JP-A 3-96964.

As toners having improved anti-offset performances, there have been proposed a toner using a covalently bonded crosslinked polymer or branch polymer inclusively called a crosslinked polymer obtained by using a polyfunctional monomer or a polyfunctional initiator (as disclosed in JP-A 3-203746 and JP-A 4-24648), a toner using an ionically bonded crosslinked polymer obtained by intimately bonding a metal oxide and a polymer (as disclosed in JP-A 61-213858 and JP-A 6-175395). These toners all may have an improved anti-offset characteristic but the resultant polymer is caused to suffer from a lowering in fixability inherent to the binder resin and is accompanied with strong entanglement of polymer molecules. As a result, the crosslinked resin component as represented by a tetrahydrofuran-insoluble matter makes difficult the dispersion of a colorant or a charge control agent within the binder resin and results in a lower pulverizability of kneaded product during toner production.

Generally, the lowest fixation or fixable temperature of a toner is present between a lower-side offset temperature and a higher-side offset temperature, so that the operable temperature region is defined between the lowest fixation temperature and the higher-side offset temperature. Accordingly, if the lowest fixation temperature is lowered as low as possible and the high-temperature offset initiation temperature is elevated as high as possible, the operable temperature region can be broadened. As a result, it becomes possible to effect energy economization, high-speed fixation and prevention of paper curling. The suppression of paper curling allows satisfactory copying on both sides of paper, intelligent-mode operation of a copying machine, accurate temperature control of a fixing device and broadening of tolerable temperature range.

For these reasons, there has been desired a toner showing good low-temperature fixability and high-temperature anti-offset characteristic.

Further, along with size reduction and compactization of copying machines and printers in recent years, the temperature within a developing device is liable to be elevated, so that the toner is required to exhibit a high-temperature storage stability which exceeds a level expected heretofore. Further, it has been also desired to provide a toner satisfying stable developing performance and good transferability in combination so as to output high-quality images.

SUMMARY OF THE INVENTION

A generic object of the present invention is to provide a toner for developing electrostatic images having solved the above-mentioned problems of a conventional toner and exhibiting excellent electrophotographic performances and fixability.

A more specific object of the present invention is to provide a toner for developing electrostatic images having a sufficient anti-offset characteristic while allowing a lower fixation temperature.

Another object of the present invention is to provide a toner for developing electrostatic images exhibiting a stable chargeability in various environmental conditions including high temperature—high humidity and low temperature—low humidity and allowing very faithful development of electrostatic images.

Another object of the present invention is to provide a toner for developing electrostatic images free from agglomeration even when left standing for a long time in a high temperature environment and capable of exhibiting similar developing performance as before the standing.

Another object of the present invention is to provide a toner for developing electrostatic images having excellent transferability.

Another object of the present invention is to provide a toner for developing electrostatic images capable of exhibiting an excellent covering power because of good dispersibility of colorant therein.

Another object of the present invention is to provide a heat and pressure fixing method allowing a broard fixation temperature range.

According to the present invention, there is provided a toner for developing an electrostatic image, comprising: toner particles containing at least a binder resin, a colorant and an organometallic compound; wherein the binder resin in the toner particles has a tetrahydrofuran-insoluble (THF-insoluble) content of at most 5.0 wt.% based on the binder resin, the toner has a glass transition temperature of 50°–80° C., the toner has a storage modulus at 80° C. ($G'_{80}$) of $1\times10^4$–$5\times10^6$ [dyn/cm$^2$], the toner has a storage modulus at 130° C. ($G'_{130}$) providing a ratio $G'_{80}/G'_{130}$ of $10$–$5\times10^3$, and the toner provides a storage modulus curve showing a minimum (G'min) in a temperature region of 110°–190° C.

According to another aspect of the present invention, there is provided a fixing method, comprising: fixing a toner image carried on a sheet material onto the sheet material under application of heat and pressure, wherein the toner image is formed of the above-mentioned toner.

These and other objects, features and advantages of the present invention will become more apparent upon a consideration of the following description of the preferred embodiments of the present invention taken in conjunction with the accompanying drawings.

DETAILED DESCRIPTION OF THE INVENTION

According to our study, it has been found possible to provide a toner exhibiting excellent low-temperature fixability, anti-high temperature offset characteristic and color mixing characteristic if the toner comprises toner particles containing a binder resin having a THF-insoluble content of at most 5.0 wt.% based on the binder resin, has a glass transition temperature of 50°–80° C. and has specific storage modulus characteristics.

In the toner of the present invention, the binder resin in the toner particles has a tetrahydrofuran-insoluble (THF-insoluble) content of at most 5.0 wt.% based on the binder resin, the toner has a glass transition temperature of 50°–80° C., the toner has a storage modulus at 80° C. ($G'_{80}$) of $1\times10^4$–$5\times10^6$ [dyn/cm$^2$], the toner has a storage modulus at 130° C. ($G'_{130}$) providing a ratio $G'_{80}/G'_{130}$ of $10$–$5\times10^3$, and the toner provides a storage modulus curve showing a minimum (G'min) in a temperature region of 110°–190° C.

A THF-insoluble content in the binder resin of at most 5.0 wt.%, preferably at most 1.0 wt.%, is effective for providing excellent low-temperature fixability and color mixing characteristic. A glass transition temperature of the toner of 50°–80° C., preferably 51°–75° C., is effective for providing excellent low-temperature fixability, anti-blocking characteristic and storage stability.

Further, excellent continuous image forming characteristic on a large number of sheets, low-temperature fixability, color mixing characteristic and anti-high temperature offset characteristic may be attained if the toner satisfies the specified storage modulus characteristics that the toner has $G'_{80}$ of $1\times10^4$–$5\times10^6$ [dyn/cm$^2$], preferably $2\times10^4$–$1\times10^6$ [dyn/cm$^2$], and a ratio ($G'_{80}/G'_{130}$) of $10$–$5\times10^3$ preferably $5\times10$–$5\times10^3$, and provides a storage modulus curve exhibiting a minimum (G'min) in a temperature region of 110°–190° C., preferably 115°–170° C.

The presence of a minimum G'min in a temperature region of 110°–190 ° C. means that the toner exhibits a higher viscoelasticity at a temperature on a higher temperature side than the temperature giving the storage-modulus minimum G'min and is therefore effective for providing the toner with very excellent anti-high temperature offset characteristic.

Figure 1:
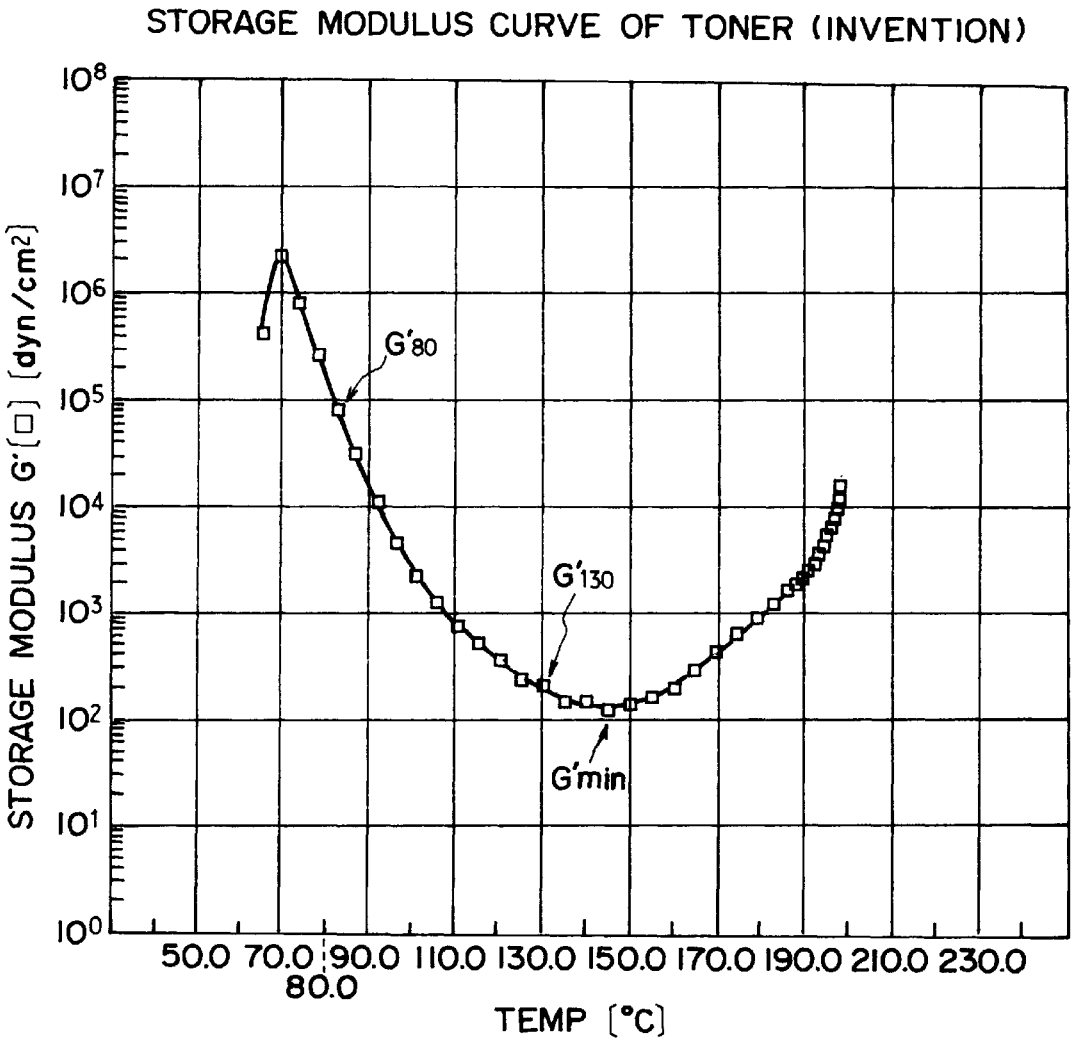
FIG. 1 is a storage modulus curve of an example toner according to the invention.

For example, for a toner providing a storage modulus curve shown in FIG. 1, $G'_{80}$ is $8.5\times10^4$ [dyn/cm$^2$], $G'_{130}$ is $2\times10^2$ [dyn/cm$^2$], the ratio ($G'_{80}/G'_{130}$) is $4.25\times10^2$, G'min is present at a temperature of 144° C. and at a value of $1.5\times10^2$ [dyn/cm$^2$], and a storage modulus at 200° C. ($G'_{200}$) is $2\times10^4$ [dyn/cm$^2$]. A toner having viscoelasticity characteristics as shown in FIG. 1 (analogous that to that of the toner obtained in Example 1 described hereinafter) is excellent in low-temperature fixability, color miscibility and anti-high temperature characteristic and exhibits a broad fixable temperature range.

Figure 2:
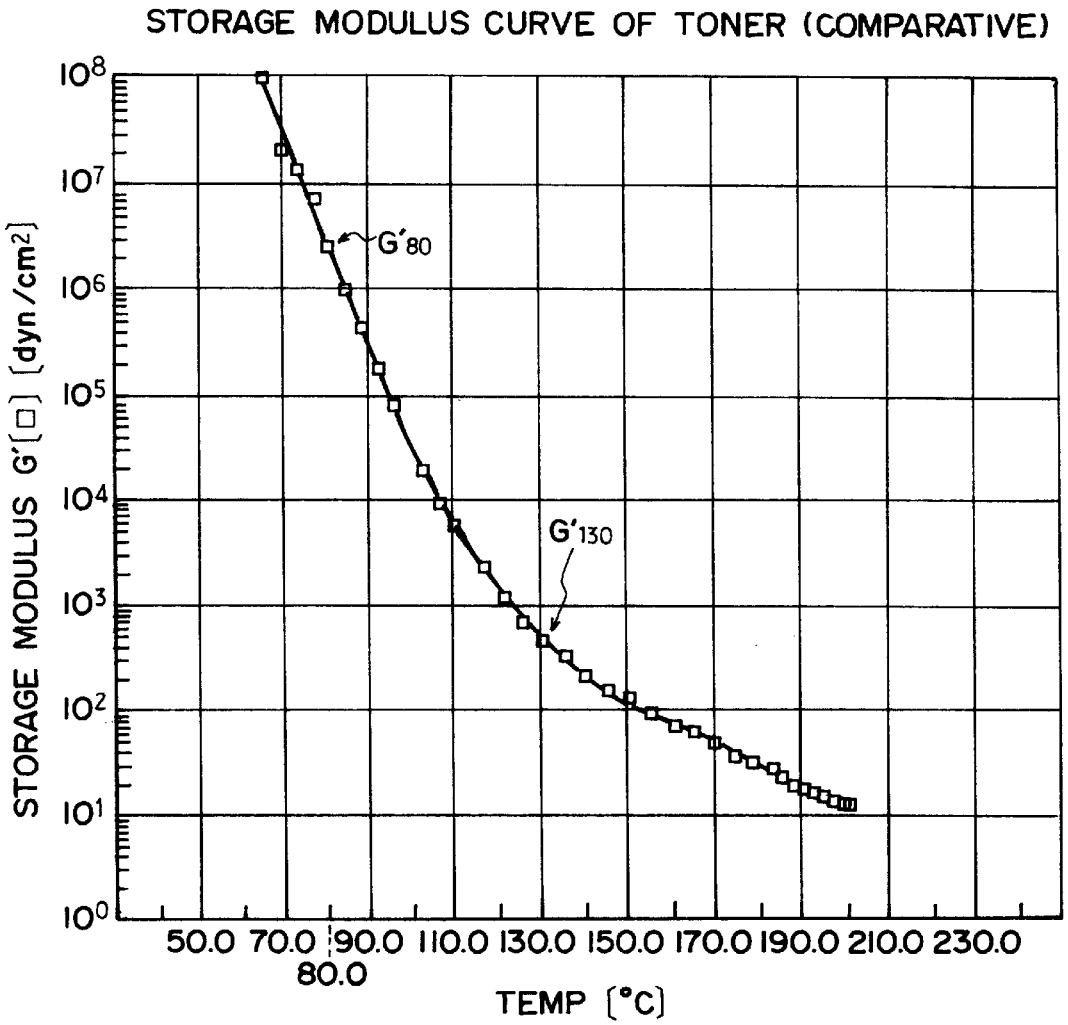
FIG. 2 is a storage modulus curve of a comparative example toner.

On the other hand, a toner having viscoelasticity characteristics as represented by a storage modulus curve shown in FIG. 2 (analogous to that of the toner obtained in Comparative Example 1 described hereinafter) does not show an explicit minimum in the temperature region of 110°–190° C. and shows a storage modulus which monotonously decreases as temperature increases on a high temperature side. Such a toner exhibits an inferior high-temperature offset characteristic and a narrower fixable temperature range than the toner according to the present invention.

The binder resin constituting the toner may preferably comprise a polymer having a carboxyl group or an acid anhydride group, or both of these. Examples of the polymer may include styrene-acrylic copolymers, styrene-methacrylic copolymers and polyester resins. It is particularly preferred to use a polyester resin.

Examples of dihydric alcohol components for producing a polyester resin may include: ethylene glycol, propylene glycol, 1,3-butanediol, 1,4-butanediol, 2,3-butanediol, diethylene glycol, triethylene glycol, 1,5-pentanediol, 1,6-hexanediol, neopentyl glycol, 2-ethyl-1,3-hexanediol, hydrogenated bisphenol A, and bisphenols derivatives represented by the following formula (A):

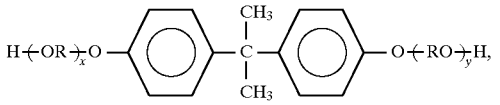

(A)

wherein R denotes an ethylene or propylene group, x and y are independently an integer of at least 1 with the proviso that the average of x+y is in the range of 2–10.

Examples of polyhydric alcohol components having three or more functional groups may include: sorbitol, 1,2,3,6-hexanetetrol, 1,4-sorbitan, pentaerythritol, dipentaerythritol, tripentaerythritol, 1,2,4-butanetriol, 1,2,5-pentanetriol, glycerol, 2-methylpropanetriol, 2-methyl-1,2,4-butanetriol, trimethylolethane, trimethylolpropane, and 1,3,5-trihydroxybenzene. Such a polyhydric alcohol may preferably be used in a proportion of 0.1–1.9 mol. % of total monomers for providing the polyester resin used.

Examples of dicarboxylic acid for producing a polyester resin may include: fumaric acid, maleic acid, maleic anhydride, succinic acid, adipic acid, sebacic acid, malonic acid, aliphatic acid monomers obtained by substituting a saturated or unsaturated hydrocarbon group having 8–22 carbon atoms for a hydrogen atom of the above-mentioned acids; and aromatic acid monomers, such as phthalic acid, isophthalic acid, phthalic anhydride, terephthalic acid and ester derivatives of these acids.

Examples of polycarboxylic acids having three or more functional groups may include: 1,2,4-benzenetricarboxylic acid, 1,2,5-benzenetricarboxylic acid, 1,2,4-naphthalenetricarboxylic acid, 2,5,7-naphthalenetricarboxylic acid, 1,2,4,5-benzenetetracarboxylic acid, and anhydrides and esters of these acids. Such a polycarboxylic acid may preferably be used in a proportion of 0.1–1.9 mol.% of total monomers for producing the polyester resin used.

The polyester resin may preferably have a glass transition temperature (Tg) of 50°–80° C., more preferably 51°–75° C. and may preferably provide a molecular weight distribution based on GPC (gel permeation chromatography) of its THF-soluble content such that it provides a number-average molecular weight (Mn) of 1000–9000, more preferably 1500–7500; a main peak molecular weight (Mp) of 5000–12000, more preferably 5500–11000; and a ratio Mw/Mn of weight-average molecular weight (Mw) to number-average molecular weight (Mn) of at most 5.0.

It is particularly preferred that the polyester resin is in a non-linear form by using a poly-basic carboxylic acid having three or more functional groups or a polyhydric alcohol having three or more functional groups and has a THF-insoluble content of at most 1 wt.% based on the polyester resin.

Such a non-linear polyester resin may preferably be produced through a process including a first stage of subjecting a dibasic carboxylic acid or a dibasic carboxylic acid ester and a dihydric alcohol to polycondensation to form a linear prepolymer, and a second stage of subjecting the linear prepolymer, a dibasic carboxylic acid (or an ester thereof), a dihydric alcohol, a tri- or more-basic polycarboxylic acid (or an ester thereof) or a tri- or more-basic alcohol to polycondensation. The polyester resin used in the present invention may preferably have an acid value of 1–30 kgKOH/g, more preferably 3–25 mgKOH/g so as to provide stable triboelectric chargeability and stable electrophotographic performances in various environments.

A particularly preferred class of polyester resin may include those having a molecular skeleton represented by the following formula (B):

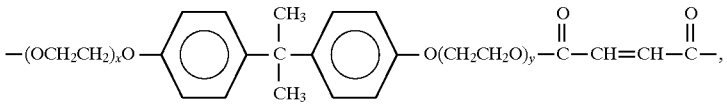

(B)

wherein x and y independently denote an integer of at least 1 providing an average of x+y in the range of 2 –4.

The polyester resin having a molecular skeleton represented by the formula (B) may preferably be provided with a non-linear structure by using a polybasic carboxylic acid or a polyhydric alcohol.

Such a polyester resin having a molecular structure represented by the formula (B) may easily form a metal ion crosslinked structure when heated together with an organometallic compound to provide a toner exhibiting a storage modulus curve giving an explicit minimum G'min in the temperature region of 110°–190 ° C.

Figure 6:
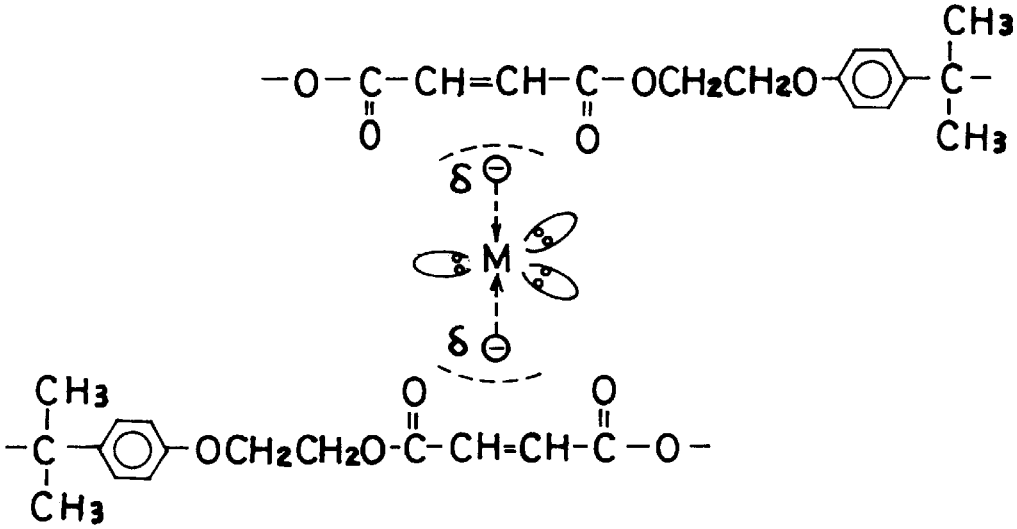
FIG. 6 illustrates an example of metal ion crosslinking of polyester polymer chains.

An example of such a metal ion crosslinked structure is illustrated in FIG. 6.

Such a polyester resin having a molecular structure represented by the formula (B) shows an excellent affinity with an organometallic compound and, based on the affinity, the molecular structure

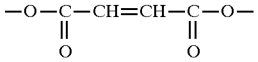

including π electrodes and oxygen atoms further donating electrons to the metal in the organometallic compound to provide a kind of coordination. This effect is particularly pronounced in the case where the metal is aluminum. This is presumably because, when an aluminum atom forms three bonds in an organometallic compound, the aluminum atom is placed in a state lacking two electrons compared with an electron octet (including four electron pairs formed from 8 electrons), and the aluminum atom in the organometallic compound tends to have 8 electrons by receiving two more electrons. This state is schematically shown in FIG. 6 wherein M may represent Al. A state as shown in FIG. 6 may be formed by a metal such as Al or a metal having a valence of at least 2 together with a molecular skeleton shown in the formula (B). This state may provide an entanglement between molecules based on a chemical affinity which is different from a conventional metal ion crosslinkage with a side or terminal carboxyl groups of a binder resin. This state may provide a combination of low-temperature fixability and anti-high temperature offset characteristic not attained heretofore and provide the following functions and effects, particularly improved fixability and transfer efficiency.

(1) The anti-offset characteristic is improved without increasing the lowest fixation temperature. Further, the toner is free from agglomeration even if left standing for a long period at a high temperature (e.g., 45° C.) and shows little change in developing performance as before the standing.

(2) The transferability is very good so that a halftone image can be faithfully reproduced on transfer paper (or transfer material) and the amount of transfer residual toner is reduced. As a result, it is possible to suppress the occurrence of toner attachment and scars during cleaning of the electrostatic image-bearing member surface.

(3) The toner flowability is very good so as to retain good chargeability (and therefore developing performance) under various environmental conditions including high temperature/high humidity, and low temperature/low humidity, thus suppressing the occurrence of fog and toner scattering in the image forming apparatus.

(4) There occurs little soiling onto a charging member, such as a developing sleeve or carrier particles, thus providing good images in a long period of use while retaining a good developing performance similarly as in the initial stage.

(5) The colorant is dispersed well in the polyester resin during toner production, so that a sufficient image density can be accomplished by adding a small amount of colorant. As the colorant dispersibility is good, re-utilization of classified fine powder fraction resulting in the classification step after fine pulverization becomes easy in the toner production process.

A further preferred class of polyester resin may be a non-linear polyester resin including a molecular skeleton represented by formula —C—D—C—D, wherein C denotes

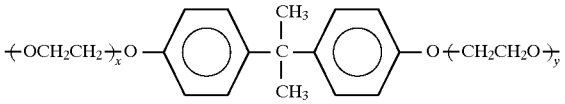

(wherein x and y are integers of at least 1) and D denotes

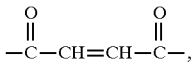

formed by connecting at least two molecular skeletons represented by the above formula (B) and non-linearized with a polycarboxylic acid or polyhydric alcohol each having three or more functional group.

Such a polyester resin having a molecular skeleton represented by the formula —C—D—C—D— may be produced by subjecting a bisphenol derivative represented by the following formula (E):

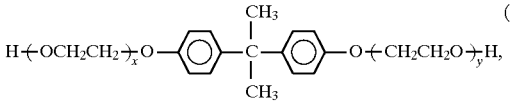

(E)

wherein x and y are integers of at least 1 providing an average of x+y of 2–4, to polycondensation with fumaric acid to form a prepolymer, and subjecting the prepolymer to polycondensation with a diol, a dicarboxylic acid and a polycarboxylic acid or polyhydric alcohol each having three or more functional groups.

The reason why the molecular skeleton shows a peculiar reactivity with an organometallic compound has not been fully clarified as yet but may be associated with the flexibility of the molecular chain assisting the formation of a coordinate position allowing easy mutual interaction, the electron donating property at P-position of the phenyl groups and the π-electron donating characteristic of —CH=CH—.

On the other hand, a bisphenol derivative having a propoxy group, like one represented by the following formula (F):

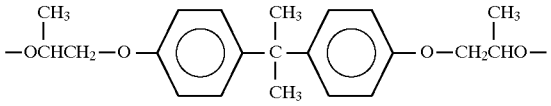

(F)

does not show such a remarkable as described above presumably because of a steric hindrance due to the presence of methyl groups.

Further, a molecular structure of the following formula (G):

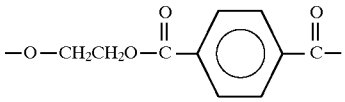

(G)

formed from ethylene glycol and terephthalic acid, and a molecular structure of the following formula (H):

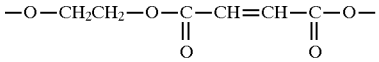

(H)

formed from ethylene glycol and fumaric acid also fail to exhibit such a remarkable effect as described above.

Figure 3:
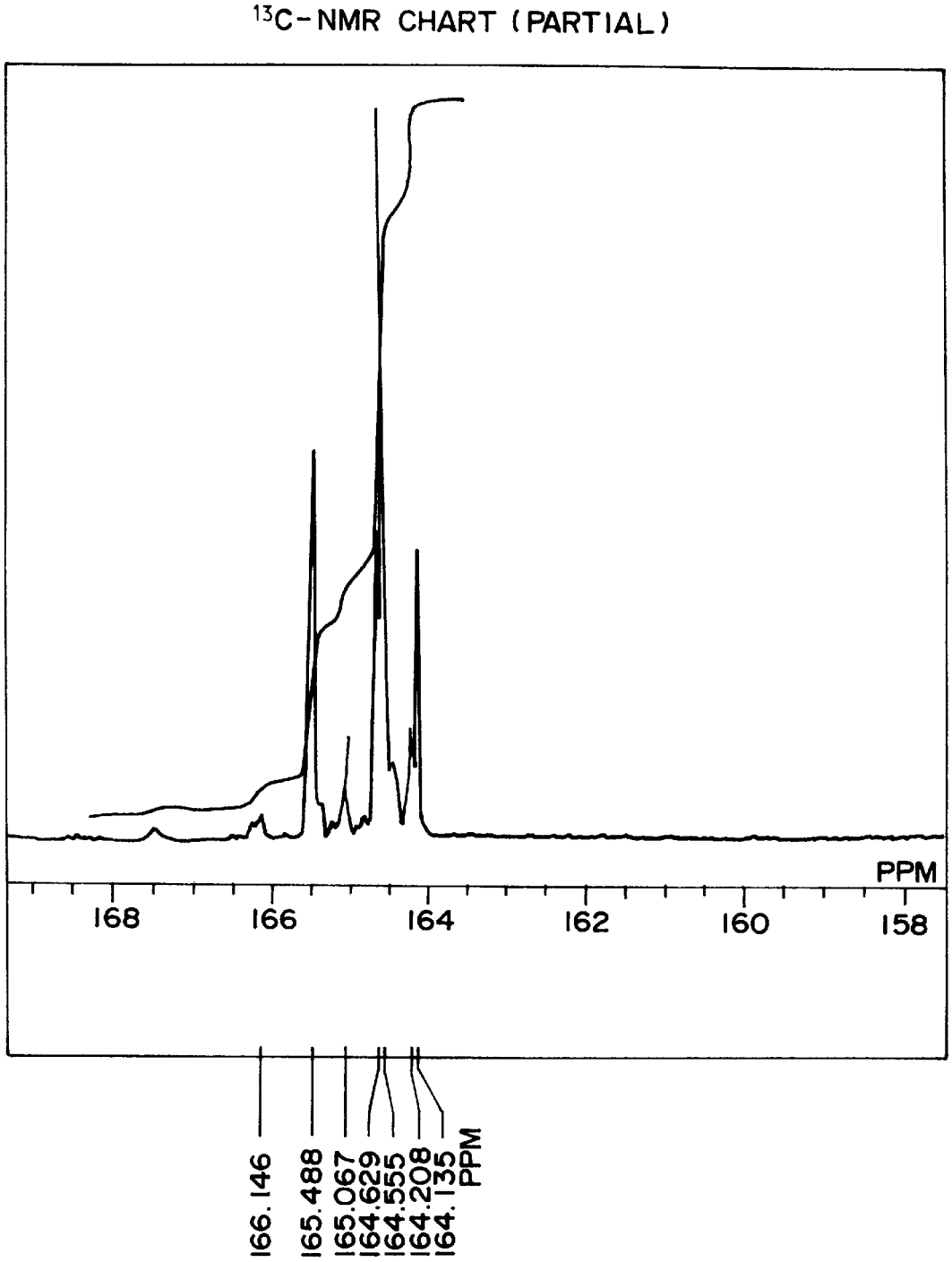
FIG. 3 shows a $^{13}$C-NMR chart (partial) of an example polyester resin.

The polyester resin used in the present invention may preferably be one providing a peak area percentage calculated by the following equation of 10 –70%:

Peak area percentage=(AC*/TAC)×100(%), wherein TAC represents an integrated value of peak area in a chemical shift value (δ value) range of 160 ppm–1800 ppm (with reference to tetramethylsilane) attributable to carboxyl carbon and AC* represents an integrated value of peak area in δ value range of 164.4–164.7 ppm, as measured according to the $^{13}$C-NMR. An example of $^{13}$C-NMR chart is shown in FIG. 3.

The integrated value TAC corresponds to the number of carbon atoms belonging to all the carboxyl groups in the polyester resin, and the integrated value AC* corresponds to the number of carbon atoms belonging to the carboxyl group in

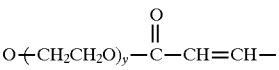

the molecular skeleton of the formula (B). If the peak area percentage is 10–70%, the dispersibility of an organometallic compound (particularly, an aromatic carboxylic acid metal compound) within the polyester resin and the mutual reactivity between the organometallic compound and the polyester resin are well adjusted to further improve the low-temperature fixability, anti-high temperature offset characteristic and developing performance of the toner.

The organometallic compound used in the present invention may preferably be an organometallic compound of an aromatic carboxylic acid and a metal having a valence of at least 2.

Examples of the aromatic carboxylic acid may include three types represented by the following formulae:

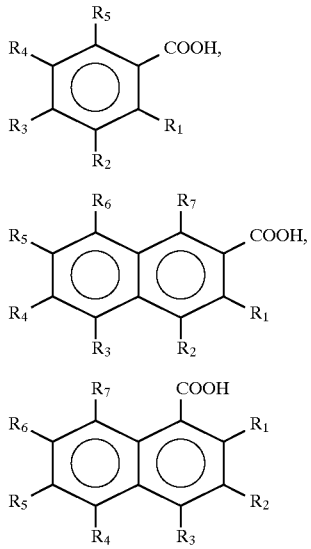

wherein $R_1$–$R_7$ independently denote hydrogen atom, an alkyl group of 1–12 carbon atom, an alkenyl group of 2–12 carbon atoms, —OH, —$NH_2$, —$NH(CH_3)$, —$N(CH_3)_2$, —$OCH_3$, —$OC_2H_5$, —COOH or —$CONH_2$.

$R_1$ may preferably be hydroxyl group, amino group or methoxy group, and hydroxyl group is most preferred. The aromatic carboxylic acid may preferably be a dialkylsalicylic acid, such as di-tert-butylsalicylic acid.

The metal constituting the organometallic compound may preferably be a metal having a valence of at least 2. Examples of divalent metal may include: $Mg^{2+}$, $Ca^{2+}$, $Sr^{2+}$, $Pb^{2+}$, $Fe^{2+}$, $Co^{2+}$, $Ni^{2+}$, $Zn^{2+}$, and $Cu^{2+}$. Among the divalent metals, $Zn^{2+}$, $Ca^{2+}$, $Mg^{2+}$ and $Sr^{2+}$ are preferred. Examples of metal having a valence of 3 or more may include: $Al^{3+}$, $Cr^{3+}$, $Fe^{3+}$ and $Ni^{3+}$. Among these metals, $Al^{3+}$, $Fe^{3+}$, $Cr^{3+}$and $Zn^{2+}$ are preferred, and $Al^{3+}$ is particularly preferred.

In the present invention, the organometallic compound may particularly preferably be di-tert-butylsalicylic acid aluminum compound.

The aromatic carboxylic acid metal compound may for example be prepared by dissolving an aromatic carboxylic acid in a sodium hydroxide aqueous solution and adding thereto dropwise an aqueous solution containing a polyvalent metal atom, followed by stirring under heating, pH adjustment, cooling to room temperature, filtering out and washing with water. The synthesis process is not restrictive.

The organometallic compound may preferably be used in an amount of 0.1–10 wt. parts, more preferably 0.5–9 wt. parts, per 100 wt. parts of the binder resin so as to adjust the viscoelastic properties and the triboelectric chargeability of the toner.

The toner according to the present invention can further contain a charge control agent, as desired, other than the above-mentioned organometallic compound so as to further stabilize the chargeability. The charge control agent may be used in 0.1–10 wt. parts, more preferably 0.1–7 wt. parts, per 100 wt. parts of the binder resin.

Examples of the charge control agent may include: nigrosine and imidazole compounds.

The colorant used for constituting the toner according to the present invention may comprise a pigment and/or a dye. Examples of the dye may include: C.I. Direct Red 1, C.I. Direct Red 4, C.I. Acid Red 1, C.I. Basic Red 1, C.I. Mordant Red 30, C.I. Direct Blue 1, C.I. Direct Blue 2, C.I. Acid Blue 9, C.I. Acid Blue 15, C.I. Basic Blue 3, C.I. Basic Blue 5, C.I. Mordant Blue 7, C.I. Direct Green 6, C.I. Basic Green 4, and C.I. Basic Green 6. Examples of the pigment may include: Mineral Fast Yellow, Navel Yellow, Naphthol Yellow S, Hansa Yellow G, Permanent Yellow NCG, Tartrazine Lake, Molybdenum Orange, Permanent Orange GTR, Pyrazolone Orange, Benzidine Orange G, Permanent Red 4R, Watching Red Ca salt, eosine lake; Brilliant Carmine 3B; Manganese Violet, Fast Violet B, Methyl Violet Lake, Cobalt BLue, Alkali Blue Lake, Victoria Blue Lake, Phthalocyanine Blue, Fast Sky Blue, Indanthrene Blue BC, Chrome Green, Pigment Green B, Malachite Green Lake, and Final Yellow Green G.

Examples of the magenta pigment for providing a toner for full-color image formation may include: C.I. Pigment Red 1, 2, 3, 4, 5, 6, 7, 8, 9, 10, 11, 12, 13, 14, 15, 16, 17, 18, 19, 21, 22, 23, 30, 31, 32, 37, 38, 39, 40, 41, 48, 49, 50, 51, 52, 53, 54, 55, 57, 58, 60, 63, 64, 68, 81, 83, 87, 88, 89, 90, 112, 114, 122, 123, 163, 202, 206, 207, 209; C.I. Pigment Violet 19; and C.I. Violet 1, 2, 10, 13, 15, 23, 29, 35.

The pigments may be used alone but can also be used in combination with a dye so as to increase the clarity for providing a color toner for full color image formation. Examples of the magenta dyes may include: oil-soluble dyes, such as C.I. Solvent Red 1, 3, 8, 23, 24, 25, 27, 30, 49, 81, 82, 83, 84, 100, 109, 121; C.I. Disperse Red 9; C.I. Solvent Violet 8, 13, 14, 21, 27; C.I. Disperse Violet 1; and basic dyes, such as C.I. Basic Red 1, 2, 9, 12, 13, 14, 15, 17, 18, 22, 23, 24, 27, 29, 32, 34, 35, 36, 37, 38, 39, 40; C.I. Basic Violet 1, 3, 7, 10, 14, 15, 21, 25, 26, 27, 28.

Other pigments include cyan pigments, such as C.I. Pigment Blue 2, 3, 15, 16, 17; C.I. Vat Blue 6, C.I. Acid Blue 45, and copper phthalocyanine pigments represented by the following formula and having a phthalocyanine skeleton to which 1–5 phthalimido-methyl groups are added:

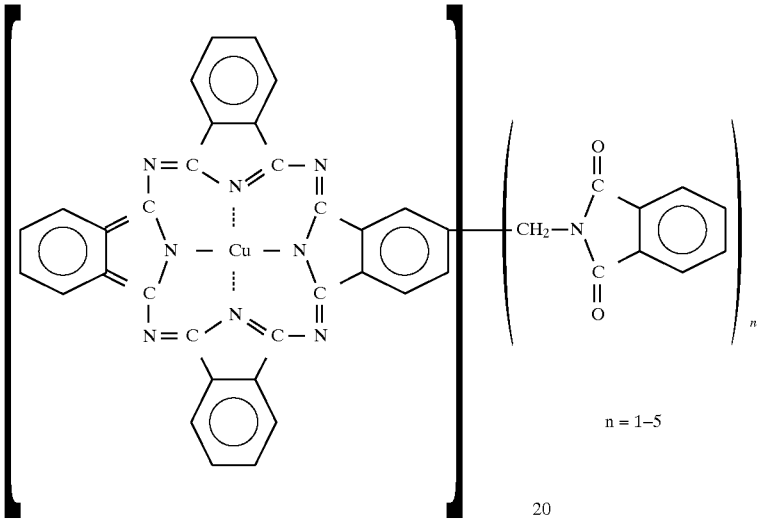

Examples of yellow pigment may include: C.I. Pigment Yellow 1, 2, 3, 4, 5, 6, 7, 10, 11, 12, 13, 14, 15, 16, 17, 23, 65, 73, 83; C.I. Vat Yellow 1, 13, 20.

Such a non-magnetic colorant may be added in an amount of 0.1–60 wt. parts, preferably 0.5–50 wt. parts, further preferably 1–15 wt. parts, per 100 wt. parts of the binder resin.

When the toner according to the present invention is constituted as a magnetic toner, the magnetic toner particles may contain a magnetic material which can also function as a colorant. Examples of the magnetic material may include: iron oxides, such as magnetite, hematite, and ferrite; iron oxides containing another metal oxide; metals, such as Fe, Co and Ni, and alloys of these metals with other metals, such as Al, Co, Cu, Pb, Mg, Ni, Sn, Zn, Sb, Be, Bi, Cd, Ca, Mn, Se, Ti, W and V; and mixtures of the above.

Specific examples of the magnetic material may include: triiron tetroxide ($Fe_3O_4$), diiron trioxide ($\gamma$-$Fe_2O_3$), zinc iron oxide ($ZnFe_2O_4$), yttrium iron oxide ($Y_3Fe_5O_{12}$), cadmium iron oxide ($CdFe_2O_4$), gadolinium iron oxide ($Gd_3Fe_5O_{12}$), copper iron oxide ($CuFe_2O_4$), lead iron oxide ($PbFe_{12}O_{19}$), nickel iron oxide ($NiFe_2O_4$), neodymium iron oxide ($NdFe_2O_3$), barium iron oxide ($BaFe_{12}O_{19}$), magnesium iron oxide ($MgFe_2O_4$), manganese iron oxide ($MnFe_2O_4$), lanthanum iron oxide ($LaFeO_3$), powdery iron (Fe), powdery cobalt (Co), and powdery nickel (Ni). Particularly suitable magnetic material for the present invention is fine powder of triiron tetroxide, magnetic ferrite or $\gamma$-diiron trioxide.

The magnetic material may have an average particle size (Dav.) of 0.1–2 $\mu$m, preferably 0.1–0.5 $\mu$m. The magnetic material may preferably show magnetic properties when measured by application of 10 kilo-Oersted, inclusive of: a coercive force (Hc) of 20–150 Oersted, a saturation magnetization ($\sigma s$) of 50–200 emu/g, particularly 50–100 emu/g, and a residual magnetization ($\sigma r$) of 2–20 emu/g.

The magnetic material may be contained in the toner in a proportion of 10–200 wt. parts, preferably 20–150 wt. parts, per 100 wt. parts of the binder resin.

The toner particles constituting the toner according to the present invention may optionally contain one or more species of release agent. Examples of the release agent may include: aliphatic hydrocarbon waxes, such as low-molecular weight polyethylene, low-molecular weight polypropylene, microcrystalline wax, and paraffin wax, oxidation products of aliphatic hydrocarbon waxes, such as oxidized polyethylene wax, and block copolymers of aliphatic hydrocarbon waxes; waxes containing aliphatic esters as principal constituents, such as carnauba wax, sasol wax, montanic acid ester wax, and partially or totally deacidified aliphatic esters, such as deacidified carnauba wax. Further examples of the release agent may include: saturated linear aliphatic acids, such as palmitic acid, stearic acid, and montanic acid; unsaturated aliphatic acids, such as brassidic acid, eleostearic acid and parinaric acid; saturated alcohols, such as stearyl alcohol, aralkyl alcohol, behenyl alcohol, carnaubyl alcohol, ceryl alcohol, and melissyl alcohol; polyhydric alcohols, such as sorbitol; aliphatic acid amides, such as linoleylamide, oleylamide, and laurylamide; saturated aliphatic acid bisamides, methylene-bisstearylamide, ethylene-biscaprylamide, and ethylene-bislaurylamide, and hexamethylene-bisstearylamide; unsaturated aliphatic acid amides, such as ethylene-bisolerylamide, hexamethylene-bisoleylamide, N,N'-dioleyladipoylamide, and N,N'-dioleylsebacoylamide, aromatic bisamides, such as m-xylene-bisstearoylamide, and N,N'-distearylisophthalylamide; aliphatic acid metal salts (generally called metallic soap), such as calcium stearate, calcium laurate, zinc stearate, and magnesium stearate; grafted waxes obtained by grafting aliphatic hydrocarbon waxes with vinyl monomers, such as styrene and acrylic acid; partially esterified products between aliphatic acids and polyhydric alcohols, such as behenic acid monoglyceride; and methyl ester compounds having hydroxyl group as obtained by hydrogenating vegetable fat and oil.

A particularly preferred class of wax may include aliphatic alcohol waxes and aliphatic hydrocarbon waxes. The aliphatic alcohol waxes may preferably be those represented by the following formula (I):

$$CH_3(CH_2)_xCH_2OH \quad (I),$$

wherein x is a positive number in the range of 20–250 as an average value.

Examples of the aliphatic hydrocarbon waxes may include: a low-molecular weight alkylene polymer wax obtained through polymerization of an alkylene by radical polymerization under a high pressure or in the presence of a Ziegler catalyst under a low pressure; an alkylene polymer obtained by thermal decomposition of an alkylene polymer of a high molecular weight; and a hydrocarbon wax obtained by subjecting a mixture gas containing carbon monoxide and hydrogen to the Arge process to form a hydrocarbon mixture and distilling the hydrocarbon mixture to recover a residue, optionally followed by hydrogen addition. Fractionation of hydrocarbon wax may preferably be performed by the press sweating method, the solvent method, vacuum distillation or fractionating crystallization. As the source of the hydrocarbon wax, it is preferred to use hydrocarbons as obtained through synthesis from a mixture of carbon monoxide and hydrogen in the presence of a metal oxide catalyst (generally a composite of two or more species), hydrocarbons having up to several hundred carbon atoms synthesized by the Synthol process, the Hydrocol process (using a fluidized catalyst bed), and the Arge process (using a fixed catalyst bed) providing a product rich in waxy hydrocarbon; and hydrocarbons obtained by polymerizing an alkylene, such as ethylene, in the presence of a Ziegler catalyst, because they are saturated long-chain hydrocarbons with little branching. It is particularly preferred to use a wax synthesized from carbon monoxide and hydrogen because of its narrow molecular weight distribution.

The wax may preferably have such a molecular weight distribution as to provide a main peak in a molecular weight region of 400–2400, more preferably 450–2000, particularly preferably 500–1600. A wax having such a molecular weight distribution can provide the toner with a preferred thermal characteristic.

The release agent may be contained in 0.1–20 wt. parts, preferably 0.5–10 wt. parts, per 100 wt. parts of the binder resin.

The release agent may be blended with the binder resin, e.g., by dissolving the resin in a solvent and adding and mixing the release agent within the resultant solution at an elevated temperature under stirring, or by melt kneading the release agent together with the binder resin.

The toner particles may preferably be blended with a flowability-improving agent externally added thereto so as to exhibit an improved image forming characteristic.

Examples of such a flowability-improving agent may include: powder of fluorine-containing resin, such as polyvinylidene fluoride fine powder and polytetrafluoroethylene fine powder; fine powdery silica such as wet-process silica and dry-process silica, fine powdery titanium oxide and fine powdery alumina and treated silica, treated titanium oxide or treated alumina obtained by surface-treating (hydrophobizing) such fine powdery silica, fine powdery titanium oxide or fine powdery alumina with silane coupling agent, titanium coupling agent, silicone oil, etc.

The flowability-improving agent may have a specific surface area of at least 30 $m^2/g$, preferably 50 $m^2/g$, as measured by the BET method according to nitrogen adsorption. The flowability-improving agent may be used in an amount of 0.01–8 wt. parts, preferably 0.1–4 wt. parts, per 100 wt. parts of the toner.

The toner particles may be prepared by sufficiently blending the binder resin(s), the colorant, the organometallic compound, and other optional additives, as desired, by a blender such as a Henschel mixer or a ball mill, followed by melt-kneading for mutual dissolution of the resins of the blend, cooling for solidification of the kneaded product, pulverization and classification to recover toner particles having a prescribed average particle size (diameter).

The toner particles may be further sufficiently blended with an external additive such as a flowability-improving agent by a blender such as a Henschel mixer to obtain a toner according to the present invention, wherein the external additive is carried on the surface of the toner particles.

The toner according to the present invention may preferably have a weight-average particle size (diameter) of 2.5–10 $\mu$m, more preferably 2.5–6.0 $\mu$m so as to provide good image quality. The toner may preferably have a volume-average particle size of 2.5–6.0 $\mu$m.

Physical parameters of a binder resin, toner particles and a toner referred to herein are generally based on values measured in the following manners.

(1) Storage Modulus of Toners

Storage modulus G' is measured by using a visco-elasticity measurement apparatus ("Rheometer RDA-II", available from Rheometrics Co.) in a temperature range of 60–210° C.

Shearing Means:

A flat disk plate having a diameter of 7.9 mm for a high-modulus sample or 40 mm for a low-modulus sample each axially connected to a transducer is used in combination with a shallow cup having a flat bottom disposed opposite to the flat disk plate of a similar diameter (ca. 8 mm or 40 mm) and connected to an actuator and a vertical cylindrical brim for containing a sample therein to be covered with the flat disk plate which is disposed with a gap of ca. 2 mm from the bottom of and rotated relative to the shallow disk with a clearance of at most 0.5 mm from the upper brim (inner wall) of the shallow cup.

Measurement Sample:

A toner is heat-melted and then molded into a disk sample having a diameter of ca. 7.9 mm and a height of 2 mm or a disk sample having a diameter of ca. 40 mm and a thickness of ca. 2 mm.

Measurement Frequency:

6.28 radian/sec.

Setting of Measurement Strain:

Initial value is set to 0.1%, and the measurement is performed according to an automatic measurement mode.

Correction for Sample Elongation:

Performed by an automatic measurement mode.

Measurement Temperature: Increased at a rate of 2° C./min, from 60° C. to 210° C.

An example of measurement results is shown in FIG. 1.

(2) THF-Insoluble Content

In Case of Binder Resin Alone 0.5–1.0 gram of a sample binder resin is weighed (at $W_1$ g), placed in a cylindrical filter (e.g., "No. 86R" available from Toyo Roshi K. K.) and subjected to extraction by means of a Soxhlet extractor with 100–200 ml of THF for 6 hours. The resultant THF solution is subjected to evaporation of the THF, and the recovered THF-soluble matter is dried for several hours under vacuum at 100° C. to weigh the THF-soluble resin content (at $W_2$ g). The THF-insoluble content is calculated from the following equation:

$$\textit{THF-insoluble content}=[(W_1-W_2)/W_1]\times 100\ (wt.\%)$$

In Case of Binder Resin Contained in Toner Particles or Toner

Preliminarily, the weight ($W_1$ g) of a binder resin and the weight ($W_3$ g) of the components other than the binder resin (including a colorant such as pigment dye or magnetic material; organometallic compound, wax and external additive, etc.) within a prescribed amount ($W_0$) of a sample toner or toner particles, are determined. Further, the weight ($W_4$ g) of THF-insoluble matter and the weight ($W_5$ g) of THF-soluble matter within the components other than the binder resin are determined. Now, the following relations hold:

$$W_0=W_1+W_3,$$

$$W_3=W_4+W_5.$$

Then, the prescribed amount ($W_0$ g) of a sample toner or toner particles are subjected to extraction by means of a Soxhlet extractor in the same manner as described above including the post treatment to determine the THF-soluble matter weight ($W_6$ g) in the sample. The THF-soluble content is calculated from the following equation:

$$THF\text{-}insoluble\ content=([W_2-(W_6-W_5)]/W_1)\times 100(wt.\%).$$

(3) Molecular Weight Distribution Measurement by GPC

The molecular weight (distribution) may be measured based on a chromatogram obtained by GPC (gel permeation chromatography).

In the GPC apparatus, a column is stabilized in a heat chamber at 40° C., tetrahydrofuran (THF) solvent is caused to flow through the column at that temperature at a rate of 1 ml/min. GPC sample solution is prepared in an amount of 50–200 $\mu$l and at a resin concentration of 0.05–0.6 wt.% and is injected into the column. The identification of sample molecular weight and its molecular weight distribution is performed based on a calibration curve obtained by using several monodisperse polystyrene samples and having a logarithmic scale of molecular weight versus count number. The standard polystyrene samples for preparation of a calibration curve may be available from, e.g., Pressure Chemical Co. or Toso K. K. It is appropriate to use at least 10 standard polystyrene samples inclusive of those having molecular weights of, e.g., $6\times10^2$, $2.1\times10^3$, $4\times10^3$, $1.75\times10^4$, $5.1\times10^4$, $1.1\times10^5$, $3.9\times10^5$, $8.6\times10^5$, $2\times10^6$ and $4.48\times10^6$. The detector may be an RI (refractive index) detector. For accurate measurement, it is appropriate to constitute the column as a combination of several commercially available polystyrene gel columns in order to effect accurate measurement in the molecular weight range of $10^3$–$2\times10^6$. A preferred example thereof may be a combination of $\mu$-styragel 500, $10^3$, $10^4$ and $10^5$ available from Waters Co.; a combination of Shodex KF-801, 802, 803, 804, 805, 806 and 807 available from Showa Denko K. K.

(4) Glass Transition Temperature (Tg)

Measurement may be performed in the following manner by using a differential scanning calorimeter ("DSC-7", available from Perkin-Elmer Corp.) according to ASTM D3418-82.

A sample in an amount of 5–20 mg, preferably about 10 mg, is accurately weighed.

The sample is placed on an aluminum pan and subjected to measurement in a temperature range of 30°–200° C. at a temperature-raising rate of 10° C./min in a normal temperature—normal humidity environment in parallel with a blank aluminum pan as a reference.

In the course of temperature increase, a main absorption peak appears in the temperature region of 40°–100° C.

In this instance, the glass transition temperature (Tg) is determined as a temperature of an intersection between a DSC curve and an intermediate line passing between the base lines obtained before and after the appearance of the absorption peak.

(5) $^{13}$C-NMR measurement $^{13}$C-NMR measurement is performed by using $CDCl_3$ as solvent and TMS (tetramethylsilane) as reference sample. Under the conditions of measurement frequency of 100.40 MHz and pulse condition of 5 $\mu$s (45 deg.), a $CDCl_3$-soluble component in a sample binder resin is subjected to the measurement of carboxyl carbon peak area (AC*) in a chemical shift value ($\delta$ value) range of 164.4–164.7 ppm and total carboxyl carbon peak area (TAC) in a chemical shift value ($\delta$ value) range of 160–180 ppm, to calculate a peak area percentage=(AC*/TAC)×100(%).

(6) Acid value (AV) (JIS-Acid Value)

Measured according to JIS K0070-1966.

a) Ca. 0.1–0.2 g of a sample is accurately weighed to record its weight at W (g).

b) The sample is placed in an Erlenmeyer flask and 100 cc of a toluene/ethanol (2/1) mixture solution is added thereto to dissolve the sample.

c) Several drops of phenolphthalein alcohol solution is added as an indicator.

d) The solution in the flask is titrated with a 0.1 N-KOH alcohol solution from a buret.

The amount of the KOH solution used for the titration is denoted by S (ml). A blank test is performed in parallel to determine the amount of the KOH solution for the blank titration at B (ml).

e) The acid value (mgKOH/g) of the sample is calculated by the following formula:

$$Acid\ value\ (mgKOH/g)=(S-B)\times f\times 5.61/W,$$

wherein f denotes a factor of the KOH solution.

(7) Particle Size Distribution of a Toner or Toner Particles

Coulter Counter TA-II or Coulter Multisizer II (available from Coulter Electronics Inc.) is used together with an electrolytic solution comprising a ca. 1% NaCl aqueous solution which may be prepared by dissolving a reagent-grade sodium chloride or commercially available as "ISOTON-II" (from Counter Scientific Japan).

For measurement, into 10 to 150 ml of the electrolytic solution, 0.1 to 5 ml of a surfactant (preferably an alkyl benzenesulfonic acid salt) is added as a dispersant, and 2–20 mg of a sample is added. The resultant dispersion of the sample in the electrolytic solution is subjected to a dispersion treatment by an ultrasonic disperser for ca. 1–3 min., and then subjected to measurement of particle size distribution by using the above-mentioned apparatus equipped with a 100 $\mu$m-aperture. The volume and number of toner particles are measured for respective channels to calculate a volume-basis distribution and a number-basis distribution of the toner. From the volume-basis distribution, a weight-average particle size ($D_4$) and volume-average particle size (Dv) of the toner or toner particles are calculated by using a central value as a representative for each channel.

The channels used include 13 channels of 2.00 –2.52 $\mu$m; 2.52–3.17 $\mu$m; 3.17–4.00 $\mu$m; 4.00–5.04 $\mu$m; 5.04–6.35 $\mu$m; 6.35–8.00 $\mu$m; 8.00–10.08 $\mu$m, 10.08–12.70 $\mu$m; 12.70–16.00 $\mu$m; 16.00–20.20 $\mu$m; 20.20–25.40 $\mu$m; 25.40–32.00 $\mu$m: and 32.00–40.30 $\mu$m.

An image forming apparatus suitable for full-color image formation by using a toner according to the present invention will be described with reference to FIG. 4.

Figure 4:
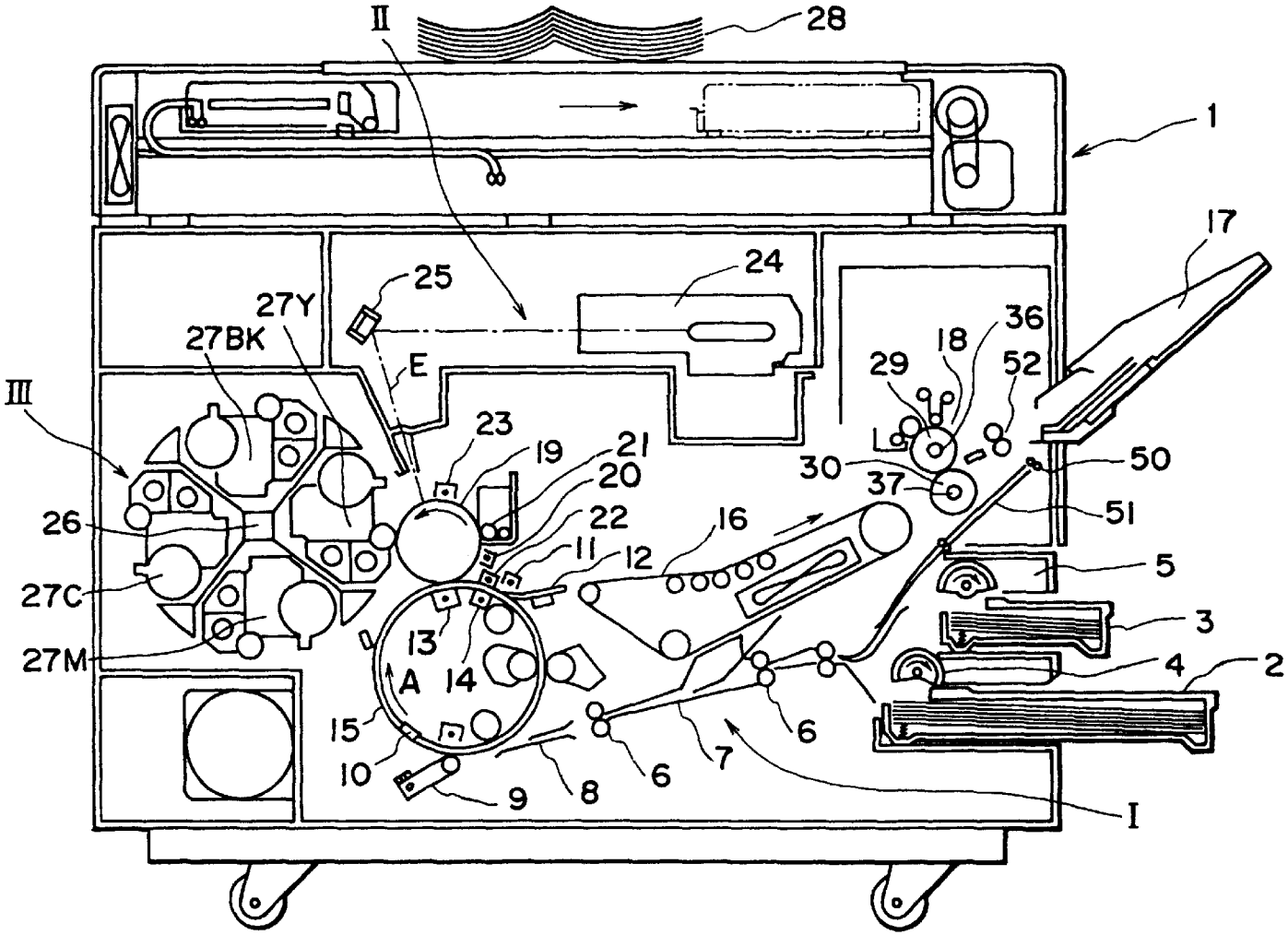
FIG. 4 is a schematic illustration of an image forming apparatus to which a toner according to the present invention may be applied.

The color electrophotographic apparatus shown in FIG. 4 is roughly divided into a transfer material (recording sheet) -conveying section I including a transfer drum 15 and extending from the right side (the right side of FIG. 4) to almost the central part of an apparatus main assembly 1, a latent image-forming section II disposed close to the transfer drum 15, and a developing means (i.e., a rotary developing apparatus) III.

The transfer material-conveying section I is constituted as follows. In the right wall of the apparatus main assembly 1, an opening is formed through which are detachably disposed transfer material supply trays 2 and 3 so as to protrude a part thereof out of the assembly. Paper (transfer material)-supply rollers 4 and 5 are disposed almost right above the trays 2 and 3. In association with the paper-supply rollers 4 and 5 and the transfer drum 15 disposed leftward thereof so as to be rotatable in an arrow A direction, paper- supply rollers 6, a paper-supply guide 7 and a paper-supply guide 8 are disposed. Adjacent to the outer periphery of the transfer drum 15, an abutting roller 9, a glipper 10, a transfer material separation charger 11 and a separation claw 12 are disposed in this order from the upstream to the downstream along the rotation direction.

Inside the transfer drum 15, a transfer charger 13 and a transfer material separation charger 14 are disposed. A portion of the transfer drum 15 about which a transfer material is wound about is provided with a transfer sheet (not shown) attached thereto, and a transfer material is closely applied thereto electrostatically. On the right side above the transfer drum 15, a conveyer belt means 16 is disposed next to the separation claw 12, and at the end (right side) in transfer direction of the conveyer belt means 16, a fixing device 18 is disposed. Further downstream of the fixing device is disposed a discharge tray 17 which is disposed partly extending out of and detachably from the main assembly 1.

The latent image-forming section II is constituted as follows. A photosensitive drum (e.g., an OPC photosensitive drum) as a latent image-bearing member rotatable in an arrow direction shown in the figure is disposed with its peripheral surface in contact with the peripheral surface of the transfer drum 15. Generally above and in proximity with the photosensitive drum 19, there are sequentially disposed a discharging charger 20, a cleaning means 21 and a primary charger 23 from the upstream to the downstream in the rotation direction of the photosensitive drum 19. Further, an imagewise exposure means including, e.g., a laser 24 and a reflection means like a mirror 25, is disposed so as to form an electrostatic latent image on the outer peripheral surface of the photosensitive drum 19.

The rotary developing apparatus III is constituted as follows. At a position opposing the photosensitive drum 19, a rotatable housing (hereinafter called a "rotary member") 26 is disposed. In the rotary member 26, four-types of developing devices are disposed at equally distant four radial directions so as to visualize (i.e., develop) an electrostatic latent image formed on the outer peripheral surface of the photosensitive drum 19. The four-types of developing devices include a yellow developing device 27Y, a magenta developing device 27M, a cyan developing apparatus 27C and a black developing apparatus 27BK.

The entire operation sequence of the abovementioned image forming apparatus will now be described based on a full color mode. As the photosensitive drum 19 is rotated in the arrow direction, the drum 19 is charged by the primary charger 23. In the apparatus shown in FIG. 4, the moving peripheral speeds (hereinafter called "process speed") of the respective members, particularly the photosensitive drum 19, may be at least 100 mm/sec, (e.g., 130–250 mm/sec). After the charging of the photosensitive drum 19 by the primary charger 23, the photosensitive drum 29 is exposed imagewise with laser light modulated with a yellow image signal from an original 28 to form a corresponding latent image on the photosensitive drum 19, which is then developed by the yellow developing device 27Y set in position by the rotation of the rotary member 26, to form a yellow toner image.

A transfer material (e.g., plain paper) sent via the paper supply guide 7, the paper supply roller 6 and the paper supply guide 8 is taken at a prescribed timing by the glipper 10 and is wound about the transfer drum 15 by means of the abutting roller 9 and an electrode disposed opposite the abutting roller 9. The transfer drum 15 is rotated in the arrow A direction in synchronism with the photosensitive drum 19 whereby the yellow toner image formed by the yellow-developing device is transferred onto the transfer material at a position where the peripheral surfaces of the photosensitive drum 19 and the transfer drum 15 abut each other under the action of the transfer charger 13. The transfer drum 15 is further rotated to be prepared for transfer of a next color (magenta in the case of FIG. 4).

On the other hand, the photosensitive drum 19 is charge-removed by the discharging charger 20, cleaned by a cleaning blade or cleaning means 21, again charged by the primary charger 23 and then exposed imagewise based on a subsequent magenta image signal, to form a corresponding electrostatic latent image. While the electrostatic latent image is formed on the photosensitive drum 19 by imagewise exposure based on the magenta signal, the rotary member 26 is rotated to set the magenta developing device 27M in a prescribed developing position to effect a development with a magenta toner. Subsequently, the abovementioned process is repeated for the colors of cyan and black, respectively, to complete the transfer of four color toner images. Then, the four color-developed images on the transfer material are discharged (charge-removed) by the chargers 22 and 14, released from holding by the glipper 10, separated from the transfer drum 15 by the separation claw 12 and sent via the conveyer belt 16 to the fixing device 18, where the four-color toner images are fixed under heat and pressure. Thus, a series of full color print or image formation sequence is completed to provide a prescribed full color image on one surface of the transfer material.

The fixing speed of the fixing device 18 is slower (e.g., at 90 mm/sec) than the peripheral speed (e.g., 160 mm) of the photosensitive drum. This is in order to provide a sufficient heat quantity for melt-mixing yet un-fixed images of two to four toner layers. Thus, by performing the fixing at a slower speed than the developing, an increased heat quantity is supplied to the toner images.

Figure 5:
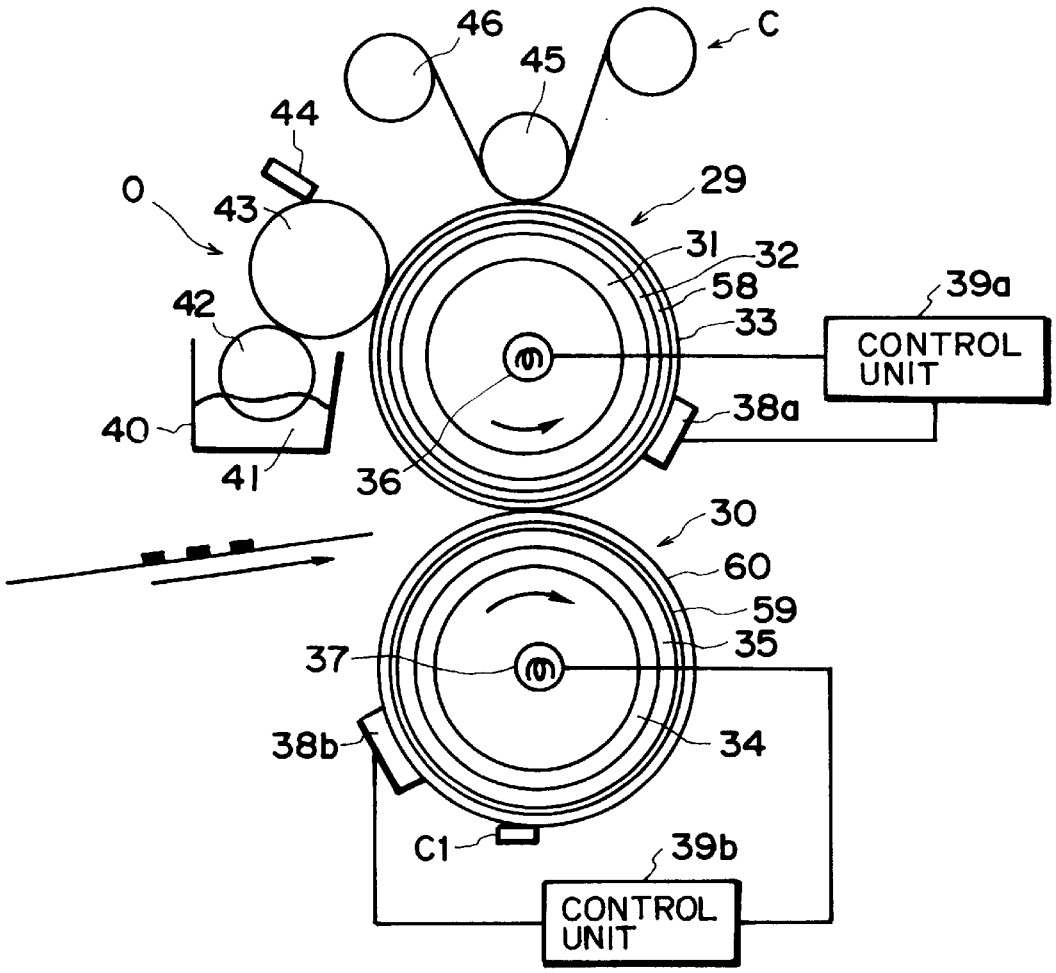
FIG. 5 is a schematic illustration of an exemplary heat and pressure fixing device for fixing a toner image formed of a toner according to the invention onto a sheet material under application of heat and pressure.

Referring to FIG. 5, a fixing roller 29 as a fixing means comprises a 5 mm-thick aluminum-made core metal (or cylinder) 31 coated successively with a 2 mm-thick RTV (room temperature vulcanization-type) silicone rubber layer 32 and a 230 $\mu$m-thick HTV (high temperature vulcanization-type) silicone rubber layer 33, and has a diameter of 60 mm.

On the other hand, a pressure roller 30 as a pressing means comprises a 5 mm-thick aluminum-made core metal (or cylinder) 34 coated successively with a 2 mm-thick RTV silicone rubber layer 35, a 50 $\mu$m-thick fluorine rubber layer 58 and a 230 $\mu$m-thick HTV silicone rubber layer 60, and has a diameter of 60 $\mu$m.

The fixing roller 29 is provided with a halogen heater 36 as a heating means disposed therein, and the pressure roller 30 is also provided with a halogen heater 37 therein so as to allow heating from both sides. The temperatures of the fixing roller 29 and the pressure roller 30 are detected by thermistors 38*a* and 38*b* abutted against the fixing roller 29 and the pressure roller 30. Based on the detected temperatures, the halogen heaters 36 and 37 are controlled by control units 39*a* and 39*b*, respectively, thereby controlling the fixing roller 29 and the pressing roller 30 respectively at constant temperatures (e.g., 160° C.±10° C.). The fixing roller 29 and the pressure roller 30 are pressed against each other at a total pressure of ca. 40 kg by a pressurizing mechanism (not shown).

Referring to FIG. 5, the fixing device further includes an oil application device O as a release agent application means, a cleaning device C, and a cleaning blade Cl for removing oil and dirt attached to the pressure roller 30. The oil application device applies, e.g., dimethylsilicone oil 41 (e.g., "IKF 96 300cs", made by Shink-Etsu Kagaku K. K.)

onto the fixing roller 29 via an oil-scooping roller 42 and an oil applicator roller 43 while controlling the oil application amount by a controller blade 44.

The cleaning device C cleans the fixing roller 29 by abutting a web of nonwoven cloth (e.g., "Nomex", available from E.I. Du Pont) against the fixing roller 29 by means of a pressing roller 45. The web is wound up about a take-up roller at an appropriate rate by a control drive mechanism (not shown) so as to prevent the pile up of toner, etc., at the abutting position with the fixing roller 29.

A transfer material carrying a fixed full-color image on one surface thereof is sent to a discharge tray 17 via paper discharge rollers 52.

Below the paper discharge rollers 52 paper re-feed rollers 50 are disposed so as to feed the transfer material once placed on the discharge tray 17 again to the latent image-forming section II, and a conveying page 51 for conveying the transfer materials is disposed downstream of the paper re-feed rollers 50.

The transfer materials on the discharge tray are fed again by the paper re-feed rollers 50 and passed through the conveying passage 51 to the latent image-forming section for-forming a color image on the back sides thereof. Thus, a transfer material carrying a fixed color image on one side and carrying a non-fixed color toner image is conveyed up to the fixing roller 29 and the pressure roller 30 to be fixed thereat, and is finally conveyed to the discharge tray 17 to complete color image formation on both sides of the transfer material.

The toner according to the present invention is excellent in low-temperature fixability and anti-high temperature off-set characteristic, so that the application amount of a release agent can be reduced, and the cleaning device is less soiled.

A toner image formed of the toner according to the present invention may preferably be fixed by a heat and pressure fixation mode at a fixing roller surface temperature in the range of 150° C.±30° C.

Hereinbelow, the present invention will be described more specifically based on Production Examples (binder resin), Synthesis Examples (organometallic compound) and Examples (toner).

In most Production Examples, diol components of the following formulae E and P having different average values of x+y were used for producing polyester resins.

[Formula E]

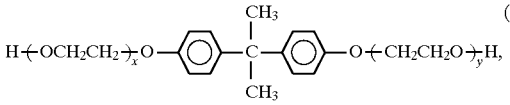

(E)

[Formula P]

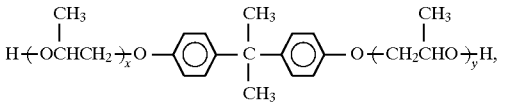

(P)

Production Example 1 (Polyester Resin)

| | |
|---|---|
| Diol component (E-1) of Formula E (x + y = 2.1) | 20 mol. % |
| Fumaric acid (HOOC − CH = CH − COOH) | 20 mol. % |

The above monomers were subjected to polycondensation to form a linear prepolymer having a number-average molecular weight (Mn) of 720.

The above-prepared linear prepolymer was subjected to polycondensation together with the following monomers to prepare a non-linear Polyester Resin (1).

| | |
|---|---|
| Diol component (E-1) | 4 mol. % |
| Diol component (P-1) of Formula P (x + y = 2.1) | 27 mol. % |
| Fumaric acid | 13.5 mol. % |
| Terephthalic acid | 14 mol. % |
| Trimellitic acid | 1.5 mol. % |

The resultant nonlinear Polyester Resin (1) had a glass transition temperature (Tg) of 56° C. and a THF-insoluble content of 0.6 wt.%, and the THF-soluble component thereof provided a GPC chromatogram exhibiting a number-average molecular weight (Mn)=2500, a main peak molecular weight (Mp)=7400, and a weight-average molecular weight (Mw)/Mn ratio of 3.7. From the $^{13}$C-NMR measurement, the nonlinear Polyester Resin (1) provided an areal percentage (AC*/TAC)×100=55.4%.

The properties of Polyester Resin (1) are summarized in Table 1 appearing hereinafter together with those of Polyester Resins (2)–(15) prepared in the following Production Examples.

Production Example 2 (Polyester Resin)

| | |
|---|---|
| Diol component (E-1) | 10 mol. % |
| Fumaric acid | 10 mol. % |

The above monomers were subjected to polycondensation to prepare a linear prepolymer having Mn=830. The linear prepolymer was mixed with the following monomers and subjected to polycondensation to prepare nonlinear Polyester Resin (2).

| | |
|---|---|
| Diol component (E-1) | 4 mol. % |
| Diol component (P-2) of Formula P (x + y = 2.3) | 37 mol. % |
| Fumaric acid | 28 mol. % |
| Terephthalic acid | 10 mol. % |
| Trimellitic acid | 1 mol. % |

The resultant nonlinear Polyester Resin (2) had Tg=59° C. and, THF-insoluble content=0.1 wt.%, provided GPC chromatogram showing Mn=3600, Mp=8000 and Mw/Mn=2.4 and (AC*/TAC)×100=33.9%.

Production Example 3 (Polyester Resin)

| | |
|---|---|
| Diol component (E-1) | 30 mol. % |
| Fumaric acid | 30 mol. % |

The above monomers were subjected to polycondensation to prepare a linear prepolymer having Mn=850. The linear prepolymer was mixed with the following monomers and subjected to polycondensation to prepare nonlinear Polyester Resin (3).

| | |
|---|---|
| Diol component (E-1) | 7 mol. % |
| Diol component (P-2) | 14 mol. % |
| Fumaric acid | 3 mol. % |
| Terephthalic acid | 15 mol. % |
| Trimellitic acid | 1 mol. % |

The resultant nonlinear Polyester Resin (3) had Tg=58.7° C. and, THF-insoluble content=0.3 wt.%, provided GPC chromatogram showing Mn=4000, Mp=8550 and Mw/Mn=4.5 and (AC */TAC)×100=68.9%.

Production Example 4 (Polyester Resin)

| | |
|---|---|
| Diol component (E-2) of Formula E (x + y = 2.2) | 5 mol. % |
| Fumaric acid | 5 mol. % |

The above monomers were subjected to polycondensation to prepare a linear prepolymer having Mn=890. The linear prepolymer was mixed with the following monomers and subjected to polycondensation to prepare nonlinear Polyester Resin (4).

| | |
|---|---|
| Diol component (E-2) | 32 mol. % |
| Diol component (P-1) | 14 mol. % |
| Fumaric acid | 3 mol. % |
| Terephthalic acid | 39 mol. % |
| Trimellitic acid | 1 mol. % |

The resultant nonlinear Polyester Resin (4) had Tg=55.3 ° C. and, THF-insoluble content=0.2 wt.%, provided GPC chromatogram showing Mn=4300, Mp=7930 and Mw/Mn=2.1 and (AC*/TAC)×100=15.9%.

Production Example 5 (Polyester Resin)

| | |
|---|---|
| Diol component (E-3) of Formula E (x + y = 2.3) | 8 mol. % |
| Fumaric acid | 8 mol. % |

The above monomers were subjected to polycondensation to prepare a linear prepolymer having Mn=670. The linear prepolymer was mixed with the following monomers an subjected to polycondensation to prepare nonlinear Polyester Resin (5).

| | |
|---|---|
| Diol component (E-3) | 2 mol. % |
| Diol component (P-1) | 41 mol. % |
| Fumaric acid | 12 mol. % |
| Terephthalic acid | 28 mol. % |
| Trimellitic acid | 1 mol. % |

The resultant nonlinear Polyester Resin (5) had Tg=57.4° C. and, THF-insoluble content=0.7 wt. 20%, provided GPC chromatogram showing Mn=2100, Mp=5100 and Mw/Mn=3.2 and (AC*/TAC)×100=21.7%.

Production Example 6 (Polyester Resin)

| | |
|---|---|
| Diol component (E-4) of Formula E (x + y = 4.0) | 5 mol. % |
| Fumaric acid | 5 mol. % |

The above monomers were subjected to polycondensation to prepare a linear prepolymer having Mn=1270. The linear prepolymer was mixed with the following monomers and subjected to polycondensation to prepare nonlinear Polyester Resin (6).

| | |
|---|---|
| Diol component (E-4) | 10 mol. % |
| Diol component (P-3) of Formula P (x + y = 2.5) | 36 mol. % |
| Fumaric acid | 3 mol. % |
| Terephthalic acid | 40 mol. % |
| Trimellitic acid | 0.5 mol. % |

The resultant nonlinear Polyester Resin (6) had Tg=56.5° C. and, THF-insoluble content=0.6 wt.%, provided GPC chromatogram showing Mn=6000, Mp=9050 and Mw/Mn=4.9 and (AC*/TAC)×100=10.9%.

Production Example 7 (Polyester Resin)

| | |
|---|---|
| Diol component (E-5) of Formula E (x + y = 3.1) | 15 mol. % |
| Fumaric acid | 15 mol. % |

The above monomers were subjected to polycondensation to prepare a linear prepolymer having Mn=1370. The linear prepolymer was mixed with the following monomers and subjected to polycondensation to prepare nonlinear Polyester Resin (7).

| | |
|---|---|
| Diol component (E-5) | 15 mol. % |
| Diol component (P-4) of Formula P (x + y = 3.1) | 20 mol. % |
| Fumaric acid | 6 mol. % |
| Terephthalic acid | 27.2 mol. % |
| Trimellitic acid | 1.8 mol. % |

The resultant nonlinear Polyester Resin (7) had Tg=56.3° C. and, THF-insoluble content=0.3 wt.%, provided GPC chromatogram showing Mn=6580, Mp=10700 and Mw/Mn=3.6 and (AC*/TAC)×100=28.5%.

Production Example 8 (Polyester Resin)

| | |
|---|---|
| Diol component (E-6) of Formula E (x + y = 3.8) | 8 mol. % |
| Fumaric acid | 8 mol. % |

The above monomers were subjected to polycondensation to prepare a linear prepolymer having Mn=1700. The linear prepolymer was mixed with the following monomers and subjected to polycondensation to prepare nonlinear Polyester Resin (8).

| | |
|---|---|
| Diol component (E-6) | 34 mol. % |
| Diol component (P-1) | 11 mol. % |
| Fumaric acid | 3 mol. % |
| Terephthalic acid | 35 mol. % |
| Trimellitic acid | 1 mol. % |

The resultant nonlinear Polyester Resin (8) had Tg=55.3° C. and, THF-insoluble content=0.8 wt.%, provided GPC chromatogram showing Mn=7950, Mp=11800 and Mw/Mn=3.9 and (AC*/TAC)×100=17.3%.

Production Example 9 (Polyester Resin)

| | |
|---|---|
| Diol component (E-7) of Formula E (x + y = 1.0) | 15 mol. % |
| Diol component (P-1) | 36 mol. % |
| Fumaric acid | 35 mol. % |
| Terephthalic acid | 14 mol. % |
| Trimellitic acid | 1 mol. % |

The above monomers were blended and subjected to polycondensation to prepare nonlinear Polyester Resin (9).

The resultant nonlinear Polyester Resin (9) had Tg=58° C., THF-insoluble content=3.2 wt.%, provided GPC chromatogram showing Mn=3700, Mp=8340 and Mw/Mn=8.2, and (AC /TAC)100=8.5%.

Production Example 10 (Polyester Resin)

| | |
|---|---|
| Diol component (P-1) | 50 mol. % |
| Fumaric acid | 49 mol. % |
| Trimellitic acid | 1 mol. % |

The above monomers were blended and subjected to polycondensation to prepare nonlinear Polyester Resin (10).

The resultant nonlinear Polyester Resin (10) had Tg=59° C., THF-insoluble content=2.9 wt.%, provided GPC chromatogram showing Mn=5000, Mp=11000 and Mw/Mn=6.3.

Production Example 11 (Polyester Resin)

| | |
|---|---|
| Diol component (E-1) | 5 mol. % |
| Diol component (P-1) | 45 mol. % |
| Fumaric acid | 4 mol. % |
| Terephthalic acid | 45 mol. % |
| Trimellitic acid | 1 mol. % |

The above monomers were blended and subjected to polycondensation to prepare nonlinear Polyester Resin (11).

The resultant nonlinear Polyester Resin (11) had Tg=59.8° C., THF-insoluble content=2.8 wt.%, provided GPC chromatogram showing Mn=3800, Mp=8100 and Mw/Mn=12.1, and (AC*/TAC)×100=5.3 %.

Production Example 12 (Polyester Resin)

| | |
|---|---|
| Diol component (E-1) | 47 mol. % |
| Diol component (P-1) | 2 mol. % |
| Terephthalic acid | 51 mol. % |

The above monomers were blended and subjected to polycondensation to prepare linear Polyester Resin (12).

The resultant linear Polyester Resin (12) had Tg=51.5° C., THF-insoluble content=15.8 wt.%, provided GPC chromatogram showing Mn=4500, Mp=9700 and Mw/Mn=3.3.

-continued

| | |
|---|---|
| Terephthalic acid | 35 mol. % |
| Trimellitic acid | 1 mol. % |

The above monomers were blended and subjected to polycondensation to prepare nonlinear Polyester Resin (13).

The resultant nonlinear Polyester Resin (13) had Tg=55.1° C., THF-insoluble content=1.9 wt.%, provided GPC chromatogram showing Mn=4000, Mp=7510 and Mw/Mn=7.4.

Production Example 14 (Polyester Resin)

| | |
|---|---|
| Diol component (E-9) of Formula E (x + y = 5.1) | 14 mol. % |
| Diol component (P-1) | 37 mol. % |
| Fumaric acid | 38 mol. % |
| Terephthalic acid | 10 mol. % |
| Trimellitic acid | 1 mol. % |

The above monomers were blended and subjected to polycondensation to prepare nonlinear Polyester Resin (14).

The resultant nonlinear Polyester Resin (14) had Tg=56.3° C., THF-insoluble content=2.5 wt.%, provided GPC chromatogram showing Mn=1900, Mp=4530 and Mw/Mn=6.7, and (AC*/TAC)×100=9.1%.

Production Example 15 (Polyester Resin)

| | |
|---|---|
| Diol component (E-10) of Formula E (x + y = 3.0) | 51 mol. % |
| Fumaric acid | 20 mol. % |
| Terephthalic acid | 20 mol. % |
| Trimellitic acid | 9 mol. % |

The above monomers were blended and subjected to polycondensation to prepare nonlinear Polyester Resin (15).

The resultant nonlinear Polyester Resin (15) had Tg=56.3° C., THF-insoluble content=7.3 wt.%, provided GPC chromatogram showing Mn=4500, Mp=9100 and Mw/Mn=10.5, and (AC*/TAC)×100=13.1%.

TABLE 1

| Polyester Resin Nos. | Tg (°C.) | THF-insoluble (wt. %) | Mn | Mp | Mw/Mn | (AC*/TAC) × 100 (%) | Acid value (mgKOH/g) |
|---|---|---|---|---|---|---|---|
| 1 | 56 | 0.6 | 2500 | 7400 | 3.7 | 55.4 | 11.5 |
| 2 | 59 | 0.1 | 3600 | 8000 | 2.4 | 33.9 | 15.8 |
| 3 | 58.7 | 0.3 | 4000 | 8550 | 4.5 | 68.9 | 7.5 |
| 4 | 55.3 | 0.2 | 4300 | 7930 | 2.1 | 15.9 | 22.0 |
| 5 | 57.4 | 0.7 | 2100 | 5100 | 3.2 | 21.7 | 18.3 |
| 6 | 56.5 | 0.6 | 6000 | 9050 | 4.9 | 10.9 | 13.4 |
| 7 | 56.3 | 0.3 | 6580 | 10700 | 3.6 | 28.5 | 24.7 |
| 8 | 55.3 | 0.8 | 7950 | 11800 | 3.9 | 17.3 | 5.3 |
| 9 | 58 | 3.2 | 3700 | 8340 | 8.2 | 8.5 | 13.7 |
| 10 | 59 | 2.9 | 5000 | 11000 | 6.3 | 0 | 18.8 |
| 11 | 59.8 | 2.8 | 3800 | 8100 | 12.1 | 5.3 | 6.1 |
| 12 | 51.5 | 15.8 | 4500 | 9700 | 3.3 | 0 | 10.1 |
| 13 | 55.1 | 1.9 | 4000 | 7510 | 7.4 | 0 | 11.3 |
| 14 | 56.3 | 2.5 | 1900 | 4530 | 6.7 | 9.1 | 22.5 |
| 15 | 56.3 | 7.3 | 4500 | 9100 | 10.5 | 13.1 | 30.5 |

Production Example 13 (Polyester Resin)

| | |
|---|---|
| Diol component (E-8) of HO—$(CH_2)_2$-OH | 25 mol. % |
| Diol component (P-1) | 25 mol. % |
| Fumaric acid | 14 mol. % |

[Production of Organometallic Compounds]

Synthesis Example 1 (Al Compound (I))

75.0 g (ca. 0.3 mol) of 3,5-di-tert-butylsalicylic acid was dissolved in 1 liter of sodium hydroxide aqueous solution (0.6 mol/l) under heating. To the resultant solution, 400 ml of aluminum sulfate aqueous solution (0.25 mol/l) was added dropwise at a rate of 10 ml/10 sec., followed by stirring for 60 min. at ca. 80° C. and recovery of the precipitate by filtration at a solution pH=5.0.

The recovered white precipitate was washed with water until pH=ca. 7 and dried to obtain an aromatic carboxylic acid aluminum compound (I) (hereinafter simply called Al compound (I)).

Synthesis Example 2 (Al Compound (II))

An aromatic carboxylic acid aluminum compound (called Al compound (II)) was prepared in the same manner as in Synthesis Example 1 except for using 75.0 g (ca. 0.3 mol) of 2-amino-3-tert-butyl-5-n-butylbenzoic acid instead of the 3,5-di-tert-butylsalicylic acid.

Synthesis Example 3 (Al Compound (III))

An aromatic carboxylic acid aluminum compound (called Al compound (III)) was prepared in the same manner as in Synthesis Example 1 except for using 75.0 g (ca. 0.3 mol) of 3-tert-butyl-4-ethoxysalicylic acid instead of the 3,5-di-tert-butylsalicylic acid.

Synthesis Example 4 (Al Compound (IV))

An aromatic carboxylic acid aluminum compound (called Al compound (IV)) was prepared in the same manner as in Synthesis Example 1 except for using 76.8 g (ca. 0.3 mol) of 3-hydroxy-7-tert-butylnaphthoic acid instead of the 3,5-di-tert-butylsalicylic acid.

Synthesis Example 5 (Zn Compound (I))

An aromatic carboxylic acid zinc compound (called Zn compound (I)) was prepared in the same manner as in Synthesis Example 1 except for replacing the aluminum sulfate aqueous solution with a zinc sulfate aqueous solution.

Synthesis Example 6 (Ca Compound (I))

An aromatic carboxylic acid calcium compound (called Ca compound.(I)) was prepared in the same manner as in Synthesis Example 1 except for replacing the aluminum sulfate aqueous solution with a calcium chloride aqueous solution.

Synthesis Example 7 (Cr Compound (I))

An aromatic carboxylic acid aluminum compound (called Cr compound (I)) was prepared in the same manner as in Synthesis Example 1 except for using 80 g (ca. 0.3 mol) of 2-methoxy-3,5-di-tert-butylbenzoic acid instead of the 3,5-di-tert-butylsalicylic acid and using a chromium sulfate aqueous solution instead of the aluminum sulfate aqueous solution.

Example 1

| | |
|---|---|
| Polyester Resin (1) | 100 wt. parts |
| Al compound (I) | 5 " |
| Copper phthalocyanine pigment | 3 " |

The above materials were sufficiently preliminarily blended by a Henschel mixer and melt-kneaded through a twin-screw extruder set at 100° C., followed by cooling, coarse pulverization by a hammer mill, fine pulverization by a fine pulverizer according to the air jet-scheme and classification by a multi-division classifier utilizing the Coanda effect, to obtain cyan-colored toner particles having a weight-average particle size of 5.9 $\mu$m.

To the toner particles, 1.5 wt.% of titanium oxide fine particles surface-treated with isobutyltrimethoxysilane and having a primary particle size of 50 nm were externally added and blended to prepare Cyan Toner (1). The properties of Cyan Toner 1 are summarized in Table 2 appearing hereinafter together with Toners obtained in other Examples described hereinafter.

7 wt. parts of Cyan Toner (1) was blended with 93 wt. parts of a Cu-Zn-Fe magnetic ferrite carrier (average particle size (Dav.)=40 $\mu$m) coated with a 50:50 (by weight)-mixture of vinylidene fluoride/tetrafluoroethylene (8/2 by weight) copolymer and styrene/2-ethylhexyl acrylate/methyl methacrylate (45/20/35 by weight) copolymer, to prepare Developer (1).

Developer (1) was incorporated in a full-color copying machine ("CLC 700", made by Canon K. K.) having an OPC photosensitive drum with a polycarbonate resin surface layer and subjected to a continuous image formation test according to a single color mode on 20000 sheets in each of three environments, i.e., normal temperature/normal humidity (NT/NH=23.5° C./60 %RH), low temperature/low humidity (LT/LH=10° C./10 %RH), and high temperature/high humidity (HT/HH=30° C./90 %RH).

Separately, a fixing performance test was performed at varying fixation speeds by removing the fixing device of the full-color copying machine and providing the fixing device with an external drive mechanism and a temperature controller. The results are inclusively shown in Table 3 appearing hereinafter.

In the image formation in the low temperature/low humidity environment, a transfer efficiency was calculated based on the amount of toner recovered in the cleaner/the consumed toner amount in order to evaluate the transferability. In the high temperature/high humidity environment, an image forming performance test was performed also after standing for two months separately from the 20000 sheets of continuous image formation test.

The results are inclusively shown in Tables 4 to 6. The toner provided high-quality images showing high resolution, excellent gradation characteristic and high image density in the respective environment. Good images identical to those in the initial stage were provided even after 20000 sheets of the continuous image formation test. No toner attachment or damages on the photosensitive drum was observed.

The results shown in Table 4–6 were evaluated in the following manner.

Image densities were measured by using a Macbeth reflective densitometer (available from Macbeth Co.) with respect to images formed at developing contrast potential differences of 350 volts in LT/LH, 30 volts in NT/NH and 250 volts in HT/HH.

Fog (%) was evaluated as a difference in whiteness (reflectance) measured by a reflective densitometer ("REFLECTOMETER", available from Tokyo Denshoku K. K.) between a white ground portion in a copy image and a white transfer paper before image formation.

Resolution was evaluated by forming an original image including 12 types of line images each including 5 lines formed at densities of 2.8, 3.2, 3.6, 4.0, 4.5, 5.0, 5.6, 6.3, 7.1, 8.0, 9.0 and 10.0 lines/mm while keeping a line width and a line spacing equal to each other. A copy image of the original was formed under proper copying conditions and observed through a magnifying glass to determine a largest density image (lines/mm) of which the respective lines could be observed clearly separately. A larger number represents a higher resolution.

Matching with a photosensitive drum was evaluated by observation with eyes of the state of occurrence of scars or damages on and residual toner sticking onto the photosensitive drum surface and the influence thereof on the resultant images. The results were evaluated according to the following standard.

A: very good (not observed)

B: good (slight scars observed but no influence on the images)

C: fair (sticking or scars observed but little influence on the images)

D: Poor (much sticking and resulting in streak image defects)

Gradation was evaluated by eye observation of images formed at 17 developing potential contrasts and evaluated according to the following standard.

A: very good

B: pretty good

C: good

D: fair

E: rather poor

F: poor

Toner agglomeration was evaluated by eye observation of an agglomeration state of a toner left standing for 2 months in the high temperature/high humidity environment according to the following standard.

A: No agglomerates at all, very good flowability.

B: No agglomerates at all.

C: Some agglomerates present but could be easily disintegrated.

D: Agglomerates could be disintegrated by the stirring means in the developing device (fair).

E: Agglomerates were not sufficiently disintegrated by the stirring means in the developing device (rather poor).

F: Poor.

The results of the above evaluation are inclusively shown in Tables 3–6 for Toner (1) prepared in Example 1 described above and other Toners prepared in the following Examples.

Examples 2–5

Cyan Toners (2)–(5) and Developers (2)–(5) were prepared and evaluated in the same manner as in Example 1 except for using Polyester Resins (2) (5), respectively, instead of Polyester Resin (1).

Example 6

Cyan toner (6) and Developer (6) were prepared and evaluated in the same manner as in Example 1 except for using Polyester Resin (6) and Al compound (II) instead of Polyester Resin (1) and Al compound (I), respectively.

Example 7

Cyan toner (7) and Developer (7) were prepared and evaluated in the same manner as in Example 1 except for using Polyester Resin (7) and Al compound (III) instead of Polyester Resin (1) and Al compound (I), respectively.

Example 8

Cyan toner (8) and Developer (8) were prepared and evaluated in the same manner as in Example 1 except for using Polyester Resin (8) and Al compound (IV) instead of Polyester Resin (1) and Al compound (I), respectively.

Example 9

Cyan toner (9) was prepared in the same manner as in Example 1 except for using a starting material composition obtained by adding 50 wt. parts of fine powder fraction recovered from the multi-division classifier to the starting materials of Example 1. From Cyan Toner (9), Developer (9) was prepared otherwise in the same manner as in Example 1. Developer (9) thus prepared was evaluated in the same manner as in Example 1.

Example 10

Cyan Toner (10) and Developer (10) were prepared and evaluated in the same manner as in Example 1 except for using Zn compound (I) instead of Al compound (I).

Example 11

Cyan Toner (11) and Developer (11) were prepared and evaluated in the same manner as in Example 1 except for using Ca compound (I) instead of Al compound (I).

Example 12

Cyan Toner (12) and Developer (12) were prepared and evaluated in the same manner as in Example 1 except for using Cr compound (I) instead of Al compound (I).

Comparative Example 1

Comparative Cyan Toner (1) and Comparative Developer (1) were prepared and evaluated in the same manner as in Example 1 except for using Polyester Resin (9) instead of Polyester Resin (1).

The results are also shown in Tables 3–6 together with those of the above-mentioned Examples and other Comparative Examples described hereinafter.

As a result of the standing in the high temperature/high humidity environment, the agglomerates of the developer and toner were observed, and slight scars could be observed on the photosensitive drum presumably attributable to the agglomerates. Further, in the continuous image formation test in the low temperature/low humidity environment, the transfer rate was lowered than in Example 1.

Comparative Example 2

Comparative Cyan Toner (2) and Comparative Developer (2) were prepared and evaluated in the same manner as in Comparative Example 1 except for using Zn compound (I) instead of Al compound (I).

The results are also shown in Tables 3–6.

Similarly as in Comparative Example 1, Comparative Developer (2) exhibited inferior results regarding image stability and fog, and particularly inferior transfer rate and agglomeration in the high temperature/high humidity environment.

Comparative Example 3

Comparative Cyan Toner (3) and Comparative Developer (3) were prepared and evaluated in the same manner as in Example 1 except for using Polyester Resin (16) instead of Polyester Resin (1).

Comparative Example 4

Comparative Cyan Toner (4) and Comparative Developer (4) were prepared and evaluated in the same manner as in Example 1 except for using Polyester Resin (11) instead of Polyester Resin (1).

Comparative Example 5

Comparative Cyan Toner (5) and Comparative Developer (5) were prepared and evaluated in the same manner as in Example 1 except for using Polyester Resin (12) instead of Polyester Resin (1).

Comparative Example 6

Comparative Cyan Toner (6) and Comparative Developer (6) were prepared and evaluated in the same manner as in Example 1 except for using Polyester Resin (13) instead of Polyester Resin (1).

Comparative Example 7

Comparative Cyan Toner (7) and Comparative Developer (7) were prepared and evaluated in the same manner as in Example 1 except for using Polyester Resin (14) instead of Polyester Resin (1).

Comparative Example 8

Comparative Cyan Toner (8) was prepared in the same manner as in Comparative Example 5 except for using a starting material composition obtained by adding 50 wt. parts of fine powder fraction recovered from the multi-division classifier to the starting materials of Comparative Example 5. From Comparative Cyan Toner (8), Comparative Developer (8) was prepared otherwise in the same manner as in Comparative Example 5. Comparative Developer (8) thus prepared was evaluated in the same manner as in Example 1.

As a result of image formation in the low temperature/low humidity environment, Comparative Developer (8) provide an initial stage image density of 1.25 and fog of 25% which were clearly inferior than 1.42 and 0.8%, respectively, of Comparative Example 5.

By comparison with the results of Examples 1 and 9, these inferior results may be attributable to inferior dispersibility of the colorant and Al compound (1) in Polyester Resin (12) used in Comparative Example 5.

Comparative Example 9

Comparative Cyan Toner (9) and Comparative Developer (9) were prepared and evaluated in the same manner as in Example 1 except for using Polyester Resin (15) instead of Polyester Resin (1).

The results of evaluation of the abovementioned Examples and Comparative Examples are inclusively given in Tables 3–6 appearing hereinafter.

TABLE 3

| | Fixing performances | | | | | |
|---|---|---|---|---|---|---|
| | Fixing speed = 180 mm/sec | | | Fixing speed = 360 mm/sec | | |
| | Fixing initiation temp. (°C.)*1 | | | Fixing initiation temp. (°C.)*1 | | |
| | Solid image*2 | Halftone image*3 | $T_{HOI}$ (°C.) | Solid image*2 | Halftone image*3 | $T_{HOI}$ (°C.) |
| Ex. | | | | | | |
| 1 | 105 (1.71) | 105 | >210 | 120 | 120 | >210 |
| 2 | 110 (1.69) | 105 | >210 | 120 | 130 | >210 |
| 3 | 110 (1.65) | 110 | >210 | 130 | 130 | >210 |
| 4 | 110 (1.61) | 110 | 205 | 125 | 125 | >210 |
| 5 | 120 (1.70) | 115 | >210 | 140 | 135 | >210 |
| 6 | 130 (1.66) | 120 | >210 | 145 | 140 | >210 |
| 7 | 130 (1.63) | 130 | >210 | 145 | 145 | >210 |
| 8 | 135 (1.64) | 130 | >210 | 150 | 145 | >210 |
| 9 | 105 (1.70) | 105 | >210 | 120 | 120 | >210 |
| 10 | 145 (1.53) | 140 | >210 | 165 | 160 | >210 |
| 11 | 140 (1.54) | 140 | 200 | 160 | 160 | >210 |
| 12 | 145 (1.51) | 140 | >210 | 165 | 160 | >210 |
| Comp. Ex. | | | | | | |
| 1 | 145 (1.59) | 140 | 175 | 170 | 165 | >210 |
| 2 | 155 (1.39) | 150 | >210 | 170 | 165 | >210 |
| 3 | 150 (1.42) | 150 | 180 | 170 | 165 | >210 |
| 4 | 135 (1.58) | 130 | 190 | 135 | 140 | >210 |
| 5 | 145 (1.46) | 140 | >210 | 155 | 150 | >210 |
| 6 | 140 (1.26) | 140 | 180 | 170 | 170 | 210 |
| 7 | 140 (1.45) | 140 | 190 | 150 | 150 | >210 |
| 8 | 140 (1.23) | 140 | >210 | 160 | 160 | >210 |
| 9 | 155 (1.33) | 150 | 200 | 170 | 165 | >210 |

*: Notes to this table are given in the next page.

TABLE 2

| | | | | | | | | Properties of binder resin in toner particles | | | |
|---|---|---|---|---|---|---|---|---|---|---|---|
| Cyan Toner | Tg of toner (°C.) | $G'_{80}$ (dyn/cm$^2$) | $G'_{130}$ (dyn/cm$^2$) | $G'_{80}/G'_{130}$ | $G'_{min}$** (°C.) | $G'_{min}$** (dyn/cm$^2$) | $G'_{200}$ (dyn/cm$^2$) | THF-insoluble (wt. %) | Mn | Mp | Mw/Mn |
| Toner | | | | | | | | | | | |
| 1 | 58.1 | $4.9 \times 10^4$ | $2.2 \times 10^2$ | $2.23 \times 10^2$ | 147 | $1.1 \times 10^2$ | $3.3 \times 10^3$ | 0.7 | 2700 | 7800 | 3.8 |
| 2 | 61.5 | $5.1 \times 10^4$ | $3.7 \times 10^2$ | $1.38 \times 10^2$ | 150 | $1.5 \times 10^2$ | $2.4 \times 10^3$ | 0.3 | 3710 | 8100 | 3.4 |
| 3 | 61.2 | $7.4 \times 10^4$ | $5.4 \times 10^2$ | $1.37 \times 10^2$ | 155 | $2.3 \times 10^2$ | $4.3 \times 10^3$ | 0.4 | 4050 | 8640 | 4.6 |
| 4 | 56.4 | $5.6 \times 10^4$ | $8.4 \times 10^2$ | $6.7 \times 10^2$ | 140 | $9.4 \times 10$ | $2.1 \times 10^3$ | 0.2 | 4310 | 8000 | 3.3 |
| 5 | 57.8 | $5.1 \times 10^5$ | $2.4 \times 10^2$ | $2.1 \times 10^3$ | 163 | $2.1 \times 10^2$ | $3.2 \times 10^4$ | 0.9 | 2290 | 5130 | 4.2 |
| 6 | 56.7 | $3.3 \times 10^5$ | $1.1 \times 10^3$ | $3.2 \times 10$ | 160 | $3.5 \times 10^2$ | $2.3 \times 10^4$ | 0.5 | 6030 | 9100 | 4.9 |
| 7 | 57.5 | $1.8 \times 10^5$ | $6.2 \times 10^2$ | $2.9 \times 10^2$ | 161 | $2.9 \times 10^2$ | $1.1 \times 10^4$ | 0.4 | 6620 | 10800 | 3.9 |
| 8 | 56.1 | $3.7 \times 10^5$ | $9.1 \times 10^2$ | $4.07 \times 10^3$ | 169 | $7.3 \times 10^2$ | $9.4 \times 10^4$ | 1.4 | 8210 | 11900 | 4.1 |
| 9 | 58.4 | $5.1 \times 10^4$ | $3.1 \times 10^2$ | $1.65 \times 10^2$ | 150 | $1.2 \times 10^2$ | $3.4 \times 10^3$ | 0.9 | 2730 | 7830 | 3.9 |
| Comp. Toner | | | | | | | | | | | |
| 1 | 58.1 | $2.4 \times 10^6$ | $2.1 \times 10^2$ | $1.14 \times 10^4$ | — | — | $1.2 \times 10$ | 3.4 | 3650 | 8340 | 9.7 |
| 2 | 58.7 | $2.4 \times 10^6$ | $4.3 \times 10^2$ | $5.68 \times 10^3$ | — | — | $2.4 \times 10^2$ | 3.4 | 3680 | 8400 | 9.9 |
| 3 | 59.1 | $3.7 \times 10^6$ | $3.3 \times 10^2$ | $1.12 \times 10^4$ | — | — | $1.3 \times 10$ | 3.5 | 5100 | 10930 | 7.4 |
| 4 | 59.8 | $7.3 \times 10^6$ | $3.9 \times 10^2$ | $1.87 \times 10^4$ | — | — | $1.6 \times 10$ | 2.9 | 3750 | 7950 | 5.9 |
| 5 | 51.7 | $2.3 \times 10^4$ | $3.1 \times 10^3$ | 7.42 | — | — | $2.5 \times 10^2$ | 14.7 | 4400 | 9730 | 5.3 |
| 6 | 55.2 | $8.9 \times 10^3$ | $5.2 \times 10^2$ | 17.1 | — | — | $1.1 \times 10$ | 2.3 | 3870 | 7540 | 8.1 |
| 7 | 56.5 | $3.4 \times 10^6$ | $2.5 \times 10^2$ | $1.36 \times 10^4$ | — | — | $1.7 \times 10$ | 9.3 | 2030 | 4600 | 7.1 |
| 8 | 51.3 | $2.3 \times 10^4$ | $3.8 \times 10^2$ | 6.05 | — | — | $2.5 \times 10$ | 2.8 | 4380 | 9750 | 5.4 |
| 9 | 56.4 | $6.7 \times 10^5$ | $4.1 \times 10^2$ | $1.63 \times 10^4$ | — | — | $3.9 \times 10$ | 11.1 | 4470 | 9030 | 12.7 |

**: All toners of Comparative Examples failed to show $G'_{min}$ in a temperature range of 80–210° C.

Notes of Table 3

1: (1) The fixing initiation temperatures are indicated by numbers (°C.) without parentheses. The numbers in the parentheses for solid images indicate image densities.
(2) The fixing temperature region was determined as a region giving an image density decrease rate of at most 5% when a fixed image (on a transfer paper of 85 g/m$^2$) was rubbed with a soft tissue paper at a pressure of 100 g/cm$^2$.

2: Solid image refers to a toner image giving a toner coverage of 0.70 mg/cm$^2$.

3: Halftone image refers to a toner image giving a toner coverage of 0.10 mg/cm$^2$.

4: $T_{HOI}$ represents a high-temperature side offset initiation temperature.

TABLE 4

| | Image forming performance evaluation in NT/NH (23.5° C./60% RH) | | | | | | | | | |
|---|---|---|---|---|---|---|---|---|---|---|
| | | | | | After 20000 sheets | | | | | |
| | Initial stage | | | | | | | | Transfer | |
| | I.D. | Gradation | Fog (%) | Resolution* (lines/mm) | I.D. | Gradation | Fog (%) | Resolution* (lines/mm) | ratio (%) | Matching |
| Ex. | | | | | | | | | | |
| 1 | 1.75 | A | 0.3 | 8.0/9.0 | 1.75 | A | 0.4. | 8.0/9.0 | 97.5 | A |
| 2 | 1.70 | A | 0.3 | 8.0/9.0 | 1.71 | A | 0.5 | 8.0/8.0 | 96.3 | A |
| 3 | 1.70 | A | 0.3 | 8.0/9.0 | 1.68 | A | 0.5 | 8.0/8.0 | 96.2 | A |
| 4 | 1.72 | A | 0.5 | 8.0/8.0 | 1.68 | A | 0.6 | 8.0/7.1 | 95.4 | A |
| 5 | 1.70 | A | 0.6 | 8.0/8.0 | 1.67 | A | 0.7 | 8.0/7.1 | 92.1 | A |
| 6 | 1.67 | A | 0.5 | 8.0/8.0 | 1.65 | A | 0.8 | 8.0/7.1 | 93.3 | B |
| 7 | 1.65 | A | 0.6 | 8.0/8.0 | 1.63 | B | 0.7 | 7.1/7.1 | 94.5 | A |
| 8 | 1.65 | A | 0.6 | 8.0/8.0 | 1.66 | B | 0.9 | 7.1/7.1 | 93.3 | A |
| 9 | 1.75 | A | 0.3 | 8.0/9.0 | 1.74 | A | 0.4 | 8.0/9.0 | 92.9 | A |
| 10 | 1.63 | A | 0.8 | 7.1/7.1 | 1.55 | D | 1.1 | 7.1/6.3 | 83.4 | B |
| 11 | 1.60 | A | 0.8 | 7.1/7.1 | 1.53 | D | 1.2 | 7.1/6.3 | 82.1 | B |
| 12 | 1.64 | A | 0.9 | 7.1/7.1 | 1.58 | D | 1.3 | 6.3/6.3 | 85.3 | B |
| Comp. Ex. | | | | | | | | | | |
| 1 | 1.59 | B | 1.3 | 7.1/6.3 | 1.39 | D | 2.3 | 6.3/6.3 | 77.2 | C |
| 2 | 1.51 | C | 1.8 | 7.1/6.3 | 1.25 | D | 2.5 | 5.3/4.0 | 71.3 | C |
| 3 | 1.50 | C | 2.0 | 7.1/7.1 | 1.29 | D | 3.8 | 4.0/4.0 | 72.4 | C |
| 4 | 1.49 | B | 1.4 | 7.1/6.3 | 1.31 | E | 3.1 | 6.3/4.0 | 80.0 | C |
| 5 | 1.48 | B | 1.3 | 6.3/5.3 | 1.42 | E | 3.1 | 6.3/5.3 | 79.5 | C |
| 6 | 1.38 | D | 3.1 | 6.3/5.3 | 1.29 | E | 3.3 | 4.0/4.0 | 70.5 | D |
| 7 | 1.43 | B | 2.0 | 7.1/7.1 | 1.31 | E | 3.7 | 6.3/5.3 | 79.5 | C |
| 8 | 1.33 | D | 2.3 | 6.3/5.3 | 1.33 | E | 3.9 | 4.0/4.0 | 73.3 | C |
| 9 | 1.45 | D | 2.1 | 6.3/7.1 | 1.31 | E | 2.8 | 5.3/6.3 | 72.4 | C |

*: Resolution is given in two directions (longitudinal/transverse).

TABLE 5

| | Image forming performance evaluation in LT/LH (10° C./10% RH) | | | | | | | | | |
|---|---|---|---|---|---|---|---|---|---|---|
| | Initial stage | | | | After 20000 sheets | | | | | |
| | I.D. | Gradation | Fog (%) | Resolution* (lines/mm) | I.D. | Gradation | Fog (%) | Resolution* (lines/mm) | Transfer ratio (%) | Matching |
| Ex. | | | | | | | | | | |
| 1 | 1.70 | A | 0.7 | 8.0/9.0 | 1.71 | A | 0.9 | 8.0/9.0 | 96.1 | A |
| 2 | 1.68 | A | 0.5 | 8.0/8.0 | 1.66 | A | 0.8 | 8.0/8.0 | 95.7 | A |
| 3 | 1.64 | A | 0.9 | 8.0/9.0 | 1.62 | A | 1.0 | 8.0/8.0 | 94.3 | A |
| 4 | 1.61 | A | 1.2 | 8.0/8.0 | 1.58 | B | 1.4 | 8.0/7.1 | 92.7 | B |
| 5 | 1.69 | A | 1.0 | 8.0/7.1 | 1.65 | B | 1.3 | 7.1/7.1 | 88.7 | A |
| 6 | 1.65 | A | 1.1 | 8.0/7.1 | 1.63 | B | 1.2 | 7.1/7.1 | 89.5 | B |
| 7 | 1.60 | B | 1.4 | 7.1/7.1 | 1.58 | B | 1.7 | 7.1/7.1 | 92.2 | A |
| 8 | 1.63 | A | 1.3 | 7.1/8.0 | 1.61 | B | 1.4 | 7.1/7.1 | 93.2 | A |
| 9 | 1.71 | A | 0.8 | 8.0/9.0 | 1.70 | A | 0.9 | 8.0/9.0 | 95.8 | A |
| 10 | 1.54 | B | 1.5 | 7.1/7.1 | 1.51 | D | 2.1 | 6.3/6.3 | 80.1 | B |
| 11 | 1.52 | B | 1.7 | 7.1/6.3 | 1.48 | D | 2.3 | 6.3/6.3 | 81.7 | B |
| 12 | 1.53 | B | 1.7 | 7.1/6.3 | 1.49 | D | 2.5 | 6.3/6.3 | 82.4 | B |
| Comp. Ex. | | | | | | | | | | |
| 1 | 1.58 | B | 1.6 | 7.1/7.1 | 1.49 | D | 2.9 | 6.3/6.3 | 76.3 | C |
| 2 | 1.40 | D | 1.9 | 6.3/6.3 | 1.27 | E | 3.9 | 4.0/4.0 | 70.2 | C |
| 3 | 1.42 | D | 2.4 | 6.3/5.3 | 1.23 | E | 3.7 | 4.0/4.0 | 70.1 | C |
| 4 | 1.59 | B | 1.5 | 7.1/7.1 | 1.47 | D | 2.8 | 7.1/6.3 | 77.9 | C |
| 5 | 1.45 | B | 1.7 | 7.1/6.3 | 1.40 | D | 2.9 | 7.1/5.3 | 78.5 | C |
| 6 | 1.24 | E | 3.9 | 5.3/4.0 | 1.15 | F | 4.0 | 4.0/3.6 | 67.8 | D |
| 7 | 1.46 | B | 2.1 | 7.1/6.3 | 1.37 | D | 3.1 | 6.3/6.3 | 75.5 | C |
| 8 | 1.25 | D | 2.5 | 6.3/4.0 | 1.10 | E | 3.8 | 4.0/4.0 | 77.2 | C |
| 9 | 1.44 | D | 2.7 | 6.3/5.3 | 1.29 | E | 3.3 | 5.3/4.0 | 72.9 | C |

TABLE 6

| | Evaluation in HT/HH (30° C./90% RH) | | | | | | | | | | |
|---|---|---|---|---|---|---|---|---|---|---|---|
| | Initial stage | | | | After 20000 sheets | | | | After standing for 2 months | | |
| | I.D. | Gradation | Fog (%) | Resolution* (lines/mm) | I.D. | Gradation | Fog (%) | Resolution* (lines/mm) | I.D. | Gradation | Agglomeration |
| Ex. | | | | | | | | | | | |
| 1 | 1.68 | A | 0.5 | 8.0/8.0 | 1.67 | A | 0.7 | 8.0/8.0 | 1.68 | A | A |
| 2 | 1.69 | A | 0.5 | 8.0/9.0 | 1.68 | A | 0.6 | 8.0/9.0 | 1.66 | A | A |
| 3 | 1.66 | A | 0.4 | 8.0/8.0 | 1.66 | A | 0.6 | 8.0/8.0 | 1.65 | A | A |
| 4 | 1.63 | A | 0.3 | 8.0/8.0 | 1.61 | A | 0.6 | 8.0/7.1 | 1.58 | A | B |
| 5 | 1.65 | B | 0.9 | 8.0/7.1 | 1.59 | B | 1.1 | 8.0/7.1 | 1.66 | C | C |
| 6 | 1.61 | A | 0.7 | 8.0/7.1 | 1.58 | A | 1.0 | 7.1/7.1 | 1.61 | B | B |
| 7 | 1.63 | A | 0.6 | 7.1/7.1 | 1.57 | B | 1.1 | 7.1/7.1 | 1.58 | B | B |
| 8 | 1.66 | A | 0.6 | 7.1/8.0 | 1.62 | A | 1.3 | 7.1/7.1 | 1.61 | A | A |
| 9 | 1.67 | A | 0.6 | 8.0/9.0 | 1.66 | A | 0.9 | 8.9/9.0 | 1.67 | B | B |
| 10 | 1.50 | B | 1.2 | 6.3/6.3 | 1.48 | D | 1.8 | 6.3/5.6 | 1.36 | D | C |
| 11 | 1.53 | B | 1.3 | 7.1/6.3 | 1.50 | D | 1.9 | 6.3/6.3 | 1.38 | D | C |
| 12 | 1.55 | B | 1.2 | 6.3/6.3 | 1.53 | D | 1.8 | 6.3/6.3 | 1.40 | D | C |
| Comp. Ex. | | | | | | | | | | | |
| 1 | 1.57 | B | 1.0 | 7.1/6.3 | 1.44 | D | 2.2 | 6.3/4.0 | 1.29 | E | D |
| 2 | 1.43 | D | 2.3 | 6.3/4.0 | 1.20 | E | 3.0 | 4.0/4.0 | 1.15 | F | F |
| 3 | 1.37 | D | 2.7 | 5.6/5.6 | 1.09 | F | 3.4 | 3.6/4.0 | | *** | |
| 4 | 1.60 | B | 1.0 | 7.1/7.1 | 1.45 | D | 2.1 | 6.3/5.6 | 1.30 | E | D |
| 5 | 1.42 | B | 0.8 | 7.1/7.1 | 1.39 | D | 1.7 | 7.1/5.6 | 1.31 | E | C |
| 6 | 1.21 | E | 3.3 | 4.0/4.0 | 1.10 | F | 4.2 | 3.6/3.6 | 1.03 | F | E |
| 7 | 1.40 | B | 1.8 | 6.3/6.3 | 1.28 | D | 2.9 | 6.3/4.0 | 1.21 | E | D |

TABLE 6-continued

| | Evaluation in HT/HH (30° C./90% RH) | | | | | | | | | | |
|---|---|---|---|---|---|---|---|---|---|---|---|
| | Initial stage | | | | After 20000 sheets | | | | After standing for 2 months | | |
| | I.D. | Gradation | Fog (%) | Resolution* (lines/mm) | I.D. | Gradation | Fog (%) | Resolution* (lines/mm) | I.D. | Gradation | Agglomeration |
| 8 | 1.29 | D | 2.4 | 6.3/4.0 | 1.07 | E | 3.8 | 4.0/4.0 | 1.03 | F | D |
| 9 | 1.42 | D | 2.8 | 5.3/5.3 | 1.30 | D | 3.2 | 4.0/4.0 | 1.19 | E | D |

***: Evaluation was impossible due to caking of the toner within the developing device.

What is claimed is:

1. A toner for developing an electrostatic image, comprising: toner particles containing at least a binder resin, a colorant and an organometallic compound; wherein the binder resin in the toner particles has a tetrahydrofuran-insoluble (THF-insoluble) content of at most 5.0 wt.% based on the binder resin, the toner has a glass transition temperature of 50°–80° C., the toner has a storage modulus at 80° C. ($G'_{80}$) of $1\times10^4$–$5\times10^6$ [dyn/cm$^2$], the toner has a storage modulus at 130° C. ($G'_{130}$) providing a ratio $G'_{80}/G'_{130}$ of 10–$5\times10^3$, and the toner provides a storage modulus curve showing a minimum (G'min) in a temperature region of 110°–190° C.

2. The toner according to claim 1, wherein said binder resin has a THF-insoluble content of at most 1.0 wt.%.

3. The toner according to claim 1, wherein said binder resin has a THF-insoluble content of at most 1.0 wt.%, and said toner has storage modulus characteristics including:

$G'_{130}=1\times10^2$–$5\times10^3$ [dyn/cm$^2$], $G'min=5\times10^3$ [dyn/cm$^2$], a storage modulus at 200° C. ($G'_{200}$)=$6\times10^3$–$1\times10^5$ [dyn/cm$^2$], and a ratio $G'_{200}/G'_{min}$=5–100.

4. The toner according to claim 1, wherein said binder resin has a carboxyl group or an acid anhydride group.

5. The toner according to claim 1, wherein said organometallic compound is an aromatic carboxylic acid metal compound.

6. The toner according to claim 1, wherein said binder resin comprises a polyester resin.

7. The toner according to claim 3, wherein said binder resin comprises a polyester resin.

8. The toner according to claim 1, wherein said binder resin comprises a polyester resin having a molecular skeleton represented by the following formula (B):

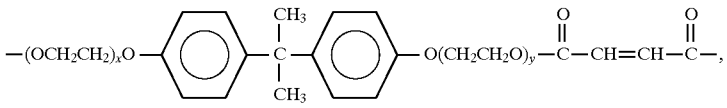

(B)

wherein x and y independently denote an integer of at least 1 providing an average of x+y in the range of 2–4.

9. The toner according to claim 8, wherein said polyester is a non-linear polyester resin.

10. The toner according to claim 8, wherein said polyester resin is one providing a peak area percentage calculated by the following equation of 10–70%:

Peak area percentage (AC*/TAC)×100(%), wherein TAC represents an integrated value of peak area in a chemical shift value (δ value) range of 160 ppm–1800 ppm (with reference to tetramethylsilane) attributable to carboxyl carbon and AC* represents an integrated value of peak area in δ value range of 164.4–164.7 ppm, as measured according to the $^{13}$C-NMR.

11. The toner according to claim 10, wherein said polyester resin has been non-linearized by reaction with a polycarboxylic acid or a polyhydric alcohol each having three or more functional groups.

12. The toner according to claim 1, wherein said organometallic compound is an aromatic carboxylic acid compound formed from an aromatic carboxylic acid and a metal atom having a valence of at least 2.

13. The toner according to claim 12, wherein said organometallic compound is an aromatic carboxylic compound formed from an aromatic carboxylic acid and an aluminum atom.

14. The toner according to claim 13, wherein said aromatic carboxylic acid is a dialkyl-salicylic acid.

15. The toner according to claim 14, wherein said aromatic carboxylic acid is di-tert-butylsalicylic acid.

16. The toner according to claim 1, wherein said toner particles contain 0.1–10 wt. parts of said organometallic compound per 100 wt. parts of the binder resin.

17. The toner according to claim 1, wherein said toner particles contain 0.5–9 wt. parts of said organometallic compound per 100 wt. parts of the binder resin.

18. The toner according to claim 1, wherein said polyester resin has a molecular skeleton represented by formula —C—D—C—D, wherein C denotes

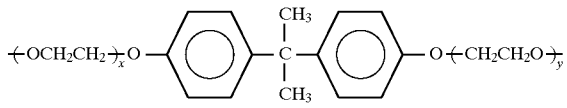

(wherein x and y are integers of at least 1) and D denotes

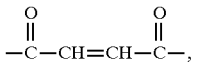

and has been non-linearized by reaction with a polycarboxylic acid having at least three functional groups.

19. The toner according to claim 18, wherein said polyester resin has an acid value of 1–30 mgKOH/g.

20. The toner according to claim 18, wherein said polyester resin has an acid value of 3–25 mgKOH/g.

21. The toner according to claim 1, wherein the toner has a weight-average particle size of 2.5–10.0 μm.

22. The toner according to claim 1, wherein the toner has a weight-average particle size of 2.5–6.0 μm .

23. The toner according to claim 1, wherein the toner has a volume-average particle size of 2.5–6.0 μm.

24. The toner according to claim 1, wherein the toner has a glass transition temperature of 51°–75° C.

25. The toner according to claim 1, wherein said binder resin contains a THF-soluble content giving a molecular weight distribution based on gel permeation chromatography providing a number-average molecular weight (Mn) of 1,000–9,000 and a main peak molecular weight (Mp) of 5,000–12,000.

26. The toner according to claim 25, wherein the THF-soluble content of said binder resin comprises a non-linear polyester resin and gives a molecular weight distribution providing a ratio of weight-average molecular weight (Mw) to number-average molecular weight (Mn) of at most 5.0.

27. The toner according to claim 1, wherein said binder resin comprises a non-linear polyester resin which has been produced by subjecting a bisphenol derivative represented by the following formula (E):

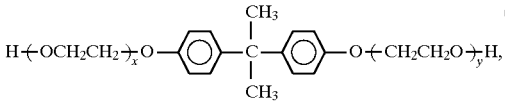

(E)

wherein x and y are integers of at least 1 providing an average of x+y of 2–4, to polycondensation with fumaric acid to form a prepolymer, and subjecting the prepolymer to polycondensation with a diol, a dicarboxylic acid and a polycarboxylic acid or polyhydric alcohol each having three or more functional groups.

28. The toner according to claim 1, wherein said toner particles have been produced by:

melt-kneading a blend comprising at least a binder resin having a THF-insoluble content of at most 1.0 wt.%, a colorant and an organometallic compound, and cooling and then pulverizing the resultant melt-kneaded product;

wherein the binder resin comprises a non-linear polyester resin which has been produced by subjecting a bisphenol drivative represented by the following formula (E):

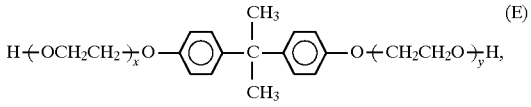

(E)

wherein x and y are integers of at least 1 providing an average of x+y of 2–4, to polycondensation with fumaric acid to form a prepolymer, and subjecting the prepolymer to polycondensation with a diol, a dicarboxylic acid and a polycarboxylic acid or polyhydric alcohol each having three or more functional groups.

29. The toner according to claim 28, wherein the toner particles contain as a binder resin component a non-linear polyester resin component formed by crosslinking the non-linear polyester resin with a metal ion.

30. A fixing method, comprising: fixing a toner image carried on a sheet material onto the sheet material under application of heat and pressure, wherein the toner image is formed of a toner comprising toner particles containing at least a binder resin, a colorant and an organometallic compound; wherein the binder resin in the toner particles has a tetrahydrofuran-insoluble (THF-insoluble) content of at most 5.0 wt.% based on the binder resin, the toner has a glass transition temperature of 50°–80° C., the toner has a storage modulus at 80° C. ($G'_{80}$) of $1\times10^4$–$5\times10^6$ [dyn/cm$^2$], the toner has a storage modulus at 130 ° C. ($G'_{130}$) providing a ratio $G'_{80}/G'_{130}$ of 10–$5\times10^3$, and the toner provides a storage modulus curve showing a minimum (G'min) in a temperature region of 110°–190° C.

31. The fixing method according to claim 30, wherein the toner image is fixed onto the sheet material by pressing a heating means at a temperature of 150°+30° C. onto the sheet material carrying the toner image.

32. The fixing method according to claim 30, wherein the toner image is formed of a toner according to any one of claims 2–29.

* * * * *

UNITED STATES PATENT AND TRADEMARK OFFICE

CERTIFICATE OF CORRECTION

PATENT NO. : 5,851,714

DATED : December 22, 1998

INVENTOR(S) : MASAAKI TAYA ET AL.

It is certified that error appears in the above-identified patent and that said Letters Patent is hereby corrected as shown below:

TITLE PAGE:

[56] REFERENCES CITED

Attorney, Agent or Firm, "Fitzpatrick, Cella Harper & Scinto" should read --Fitzpatrick, Cella, Harper & Scinto--.

COLUMN 8

Line 15, "remarkable" should read --remarkable reactivity--.

COLUMN 10

Line 27, "Cobalt BLue," should read --Cobalt Blue,--.

COLUMN 21

Line 31, "an" should read --and--.
Line 42, "content=0.7 wt. 20%," should read --content=0.7 wt. %,--.

UNITED STATES PATENT AND TRADEMARK OFFICE

CERTIFICATE OF CORRECTION

PATENT NO. : 5,851,714

DATED : December 22, 1998

INVENTOR(S) : MASAAKI TAYA ET AL.

It is certified that error appears in the above-identified patent and that said Letters Patent is hereby corrected as shown below:

COLUMN 22

Line 67, "(AC/TAC)" should read --(AC*/TAC)--.

COLUMN 27

Line 33, "Resins (2) (5)," should read --Resins (2)-(5),--.

COLUMN 28

Line 25, "lowered" should read --lower--.

COLUMN 29

Line 17, "provide" should read --provided--.

COLUMN 31

Table 4, In "Ex. 1", under col. "After 2000 sheets", under subcolumn "Fog(%)", "0.4." should read --0.4--.

UNITED STATES PATENT AND TRADEMARK OFFICE

CERTIFICATE OF CORRECTION

PATENT NO. : 5,851,714

DATED : December 22, 1998

INVENTOR(S) : MASAAKI TAYA ET AL.

It is certified that error appears in the above-identified patent and that said Letters Patent is hereby corrected as shown below:

COLUMN 35

Line 37, "G'min=5x10$^3$[dyn/cm$^2$]," should read --G'min=5x10-5x10$^3$[dyn/cm$^2$],--.

COLUMN 36

Line 15, "percentage" should read --percentage=--.

COLUMN 38

Line 35, "130 ° C." should read --130°C.--.
Line 42, "150°+30°C." should read --150°±30°C--.

Signed and Sealed this

Twenty-first Day of December, 1999

*Attest:*

Q. TODD DICKINSON

*Attesting Officer*

*Acting Commissioner of Patents and Trademarks*